US007631621B2

(12) United States Patent
Fujii et al.

(10) Patent No.: US 7,631,621 B2
(45) Date of Patent: Dec. 15, 2009

(54) ENGINE VALVE OPERATING SYSTEM

(75) Inventors: Noriaki Fujii, Wako (JP); Katsunori Nakamura, Wako (JP); Akiyuki Yonekawa, Wako (JP); Tomoya Fujimoto, Wako (JP); Keiko Yoshida, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 151 days.

(21) Appl. No.: 10/585,831

(22) PCT Filed: Jan. 13, 2005

(86) PCT No.: PCT/JP2005/000292

§ 371 (c)(1),
(2), (4) Date: Jul. 10, 2008

(87) PCT Pub. No.: WO2005/068791

PCT Pub. Date: Jul. 28, 2005

(65) Prior Publication Data

US 2008/0271691 A1 Nov. 6, 2008

(30) Foreign Application Priority Data

Jan. 16, 2004 (JP) ..... 2004-009396
Jan. 30, 2004 (JP) ..... 2004-023953
Dec. 2, 2004 (JP) ..... 2004-350023

(51) Int. Cl.
*F01L 1/34* (2006.01)

(52) U.S. Cl. ..... 123/90.16; 123/90.15

(58) Field of Classification Search ..... 123/90.15, 123/90.16

See application file for complete search history.

(56) References Cited

U.S. PATENT DOCUMENTS

2006/0102118 A1* 5/2006 Fujii et al. ..... 123/90.16

FOREIGN PATENT DOCUMENTS

EP 1 548 240 A1 6/2005

(Continued)

OTHER PUBLICATIONS

Office Action dated Sep. 17, 2008 corresponding to Japanese application No. 2004-023953.
Supplementary European Search Report dated Nov. 6, 2008.

*Primary Examiner*—Zelalem Eshete
(74) *Attorney, Agent, or Firm*—Kratz, Quintos & Hanson, LLP

(57) ABSTRACT

A rocker arm (63) is provided with a valve connecting portion (63*a*) into which tappet screws (70) abutting against a pair of engine valves (19) are screwed so that their advance/retract positions can be adjusted, and the rocker arm (63) has a cam abutting portion (65) which abuts against a valve operating cam (69) and is interlocked and connected to the engine valves (19). The rocker arm (63) turnably connects to one end of a first link arm (61) turnably supported at a fixed position of an engine body and to one end of a second link arm turnably supported by a displaceable movable support shaft (68*a*). The rocker arm (63) is formed so that the valve connecting portion (63*a*) has a larger width in a direction along a rotating axis of the valve operating cam (69) than in the remaining part. This enables the lift amount of the engine valves to be continuously varied. It is also possible to reduce the size of the system, while ensuring follow-up ability of the opening/closing operations.

10 Claims, 20 Drawing Sheets

FOREIGN PATENT DOCUMENTS

| | | | |
|---|---|---|---|
| EP | 1 628 007 | A1 | 2/2006 |
| EP | 1 707 765 | A1 | 10/2006 |
| EP | 1 707 766 | A1 | 10/2006 |
| JP | 62-185809 | | 11/1987 |
| JP | 3-116710 | | 12/1991 |
| JP | 5-202720 | | 8/1993 |
| JP | 8-74534 | | 3/1996 |
| JP | 11-218006 | | 8/1999 |
| JP | 2002-129916 | | 5/2002 |
| JP | 2003-49612 | | 2/2003 |
| JP | 2003-166405 | | 6/2003 |
| JP | 2004-36560 | | 2/2004 |
| JP | 2004-353599 | | 12/2004 |
| WO | WO 03/008772 | A1 | 1/2003 |

* cited by examiner

HIGH VALVE LIFT

LOW VALVE LIFT

ENGINE VALVE OPERATING SYSTEM

TECHNICAL FIELD

The present invention relates to an engine valve operating system equipped with a variable valve lift mechanism which continuously varies the lift amount of an engine valve, namely an intake valve or exhaust valve.

BACKGROUND ART

A valve operating system in which one end of a push rod is fitted to one end of a rocker arm having a valve abutment part abutting to an engine valve at the other end side and a link mechanism is provided between the other end of the push rod and a valve operating cam in order to continuously change the amount of lift of the engine valve is already known by Patent Document 1.

However, in the engine valve operating mechanism disclosed in the above-described Patent Document 1, it is necessary to ensure a comparatively large space to dispose a link mechanism and the push rod therein, between the valve operating cam and the rocker arm, and therefore, the valve operating system becomes large in size. In addition, a driving force from the valve operating cam is transmitted to the rocker arm via the link mechanism and the push rod, and therefore, it is difficult to say follow-up ability of the rocker arm to the valve operating cam, namely, follow-up ability of opening and closing operation of the engine valve is excellent.

Thus, the applicant already proposes an engine valve operating system in which one end portions of a first and second link arm are rotatably connected to a rocker arm, the other end portion of the first link arm is rotatably supported at an engine body, and the other end portion of the second link arm is displaced by drive means in Patent Document 2. According to the valve operating system, it is possible to make the valve operating system compact and it is also possible to ensure excellent follow-up ability to the valve operating cam by directly transmitting the power from the valve operating cam to the rocker arm.

Patent Document 1:

Japanese Patent Application Laid-open No. 8-74534

Patent Document 2:

Japanese Patent Application Laid-open No. 2004-36560

DISCLOSURE OF THE INVENTION

Problem to be Solved by the Invention

To reduce the size of the valve operating system, it is important to minimize the width along a turning axis of the rocker arm. However, if a single rocker arm is used to drivingly open a pair of engine valves, the rocker arm is desirably configured so that a valve connecting portion provided on the rocker arm so as to be connected to the engine valves has a maximum width, in order to minimize the width of the rocker arm. This is because the distance between the engine valves is substantially determined by the shape and dimensions of a combustion chamber and because the width of the valve connecting portion is in turn determined by the distance between the engine valves.

The present invention has been achieved in view of the above-mentioned circumstances, and has an object to provide an engine valve operating system which allows the lift amount of an engine valve to be continuously varied and which has a reduced size, while ensuring follow-up ability of the opening/closing operations.

Means for Solving the Problem

In order to achieve the object, according to a first feature of the present invention, there is provided an engine valve operating system comprising a rocker arm which has a cam abutting portion abutting against a valve operating cam and which is interlocked and connected to an engine valve, a first link arm having one end turnably connected to the rocker arm and the other end turnably supported at a fixed position of the engine body, a second link arm having one end turnably connected to the rocker arm and the other end turnably supported by a displaceable movable support shaft, and driving means connected to the movable support shaft to enable a position of the movable support shaft to be displaced in order to continuously vary the lift amount of the engine valve, wherein the rocker arm having a valve connecting portion into which tappet screws abutting against a pair of engine valves are screwed so that their advance/retract positions can be adjusted and a first and second support portions to which the one ends of the first and second link arms are turnably connected is formed so that the valve connecting portion has a larger width in a direction along a rotating axis of the valve operating cam than in a remaining part.

In addition to the first feature, according to a second aspect of the present invention, the other end of the first link arm is turnably supported via a support shaft by support walls provided in the engine body so as to lie on opposite sides of the other end of the first link arm. An interposition is placed between the other end of the first link arm and each of the support walls.

In addition to the second feature, according to a third aspect of the present invention, the interposition is a torsion spring provided between the engine body and the rocker arm so as to bias the rocker arm in a side in which the cam abutting portion abuts against the valve operating cam.

In addition to the first feature, according to a fourth aspect of the present invention, the first support portion is formed into a substantial U shape so as to sandwich a roller which is the cam abutting portion, between the opposite sides, and the roller is rotatably supported by the first support portion.

In addition to the fourth feature, according to a fifth aspect of the present invention, a pair of connecting portions is provided at the one end of the first link arm so as to sandwich the first support portion of the rocker arm between the connecting portions. The connecting portions are turnably connected to the first support portion via a connecting shaft. The roller is axially supported by the first support portion via the connecting shaft.

In addition to the first feature, according to a sixth aspect of the present invention, the rocker arm is formed so that the first and second support portions have the same width.

In addition to the first feature, according to a seventh aspect of the present invention, connecting holes through which connecting shafts used to turnably connect the one ends of the first and second link arms are inserted are formed in the first and second support positions so as to be side by side in a direction of opening/closing directions of the engine valves. The first and second support portions are connected together by a connecting wall at least partly placed opposite from the engine valves with respect to a tangent contacting with outer edges of the connecting holes near the engine valves.

In addition to the seventh feature, according to an eighth aspect of the present invention, a concave portion is formed in the connecting wall at a position opposite from the other end of the second link arm when the other end of the second link arm is closest to the rocker arm.

In addition to the seventh feature, according to a ninth aspect of the present invention, a lightening portion is formed in the connecting wall.

In addition to the first feature, according to a tenth aspect of the present invention, lightening portions are alternately formed in opposite surfaces of the rocker arm molded.

Effect of the Invention

With the first feature of the present invention, the lift amount of the engine valve can be continuously varied by continuously displacing the movable support shaft. Further, since one ends of each of the first and second link arms are turnably connected directly to the rocker arm. This allows a reduction in the size of the space in which the link arms are arranged, and in the size of the valve operating system. Furthermore, power from the valve operating cam is transmitted directly to the cam abutting portion of the rocker arm. This ensures excellent follow-up ability of the rocker arm to the valve operating cam. Moreover, the rocker arm drivingly opens the pair of engine valves. The rocker arm has the valve connecting portion into which the tappet screws abutting against a pair of engine valves are screwed so that their advance/retract positions can be adjusted, and the first and second support portions to which the one ends of the first and second link arms are turnably connected. The rocker arm is formed so that the width of the valve connecting portion in the direction along the turning axis of the valve operating cam is larger than that of the remaining part. It is thus possible to minimize the width of the rocker arm in the direction along the turning axis of the valve operating cam. This also enables a reduction in the size of the valve operating system.

With the second feature of the present invention, the interposition is placed between the other end of the first link arm and each of the support walls provided in the engine body so as to lie on the opposite sides of the other end of the first link arm. The selection of the interposition enables the first link arm to be positioned so that the interposition can absorb the dimensional tolerance between the first link arm and the support walls.

With the third feature of the present invention, a torsion spring which biases the rocker arm in the direction in which the cam abutting portion abuts against the valve operating cam serves as the interposition. This facilitates the absorption of the dimensional tolerance. It is also possible to ensure that the cam abutting portion abuts against the valve operating cam. This increases the accuracy with which the valve lift amount is controlled.

With the fourth feature of the present invention, the first support portion formed into a substantially U-shape rotatably supports the roller. This enables a reduction in the size of the whole rocker arm including the roller.

With the fifth feature of the present invention, the common connecting shaft is used to turnably connect the one end of the first link arm to the first support portion and to allow the first support portion to axially support the roller. This enables a reduction in the number of parts required and thus a further reduction in the size of the valve operating system.

With the sixth feature of the present invention, the first and second support portions have the same width. This makes it possible to reduce the size of the rocker arm, while simplifying its shape.

With the seventh feature of the present invention, the first and second support portions of the rocker arm are connected together by the connecting wall at least partly placed opposite from the engine valves with respect to the tangent contacting with the outer edges of the pair of connecting holes near the engine valve formed in the support portions. This serves to enhance the rigidity of the first and second support portions.

With the eighth feature of the present invention, the other end of the second link arm can be displaced as close to the rocker arm as possible. This enables the maximum lift amount of the engine valves to be set at as large a value as possible, while allowing a reduction in the size of the valve operating system.

With the ninth feature of the present invention, it is possible to prevent an increase in the weight of the rocker arm, while enhancing the rigidity using the connecting wall.

With the tenth feature of the present invention, the lightening portions are alternately formed in opposite surfaces of the rocker arm. This makes it possible to reduce the weight of the rocker arm. The lightening portions are formed when the rocker arm is molded, and the adjacent lightening portions have draft angles in opposite directions. Accordingly, inner surfaces of the adjacent lightening portions are inclined in the same direction. Therefore, the wall portions formed in the rocker arm between the adjacent lightening portions have substantially an equal uniform in thickness. The wall portions with the substantially equal thickness allow the rigidity of the rocker arm to be maintained.

DESCRIPTION OF REFERENCE NUMERALS AND CHARACTERS

Figure 1:
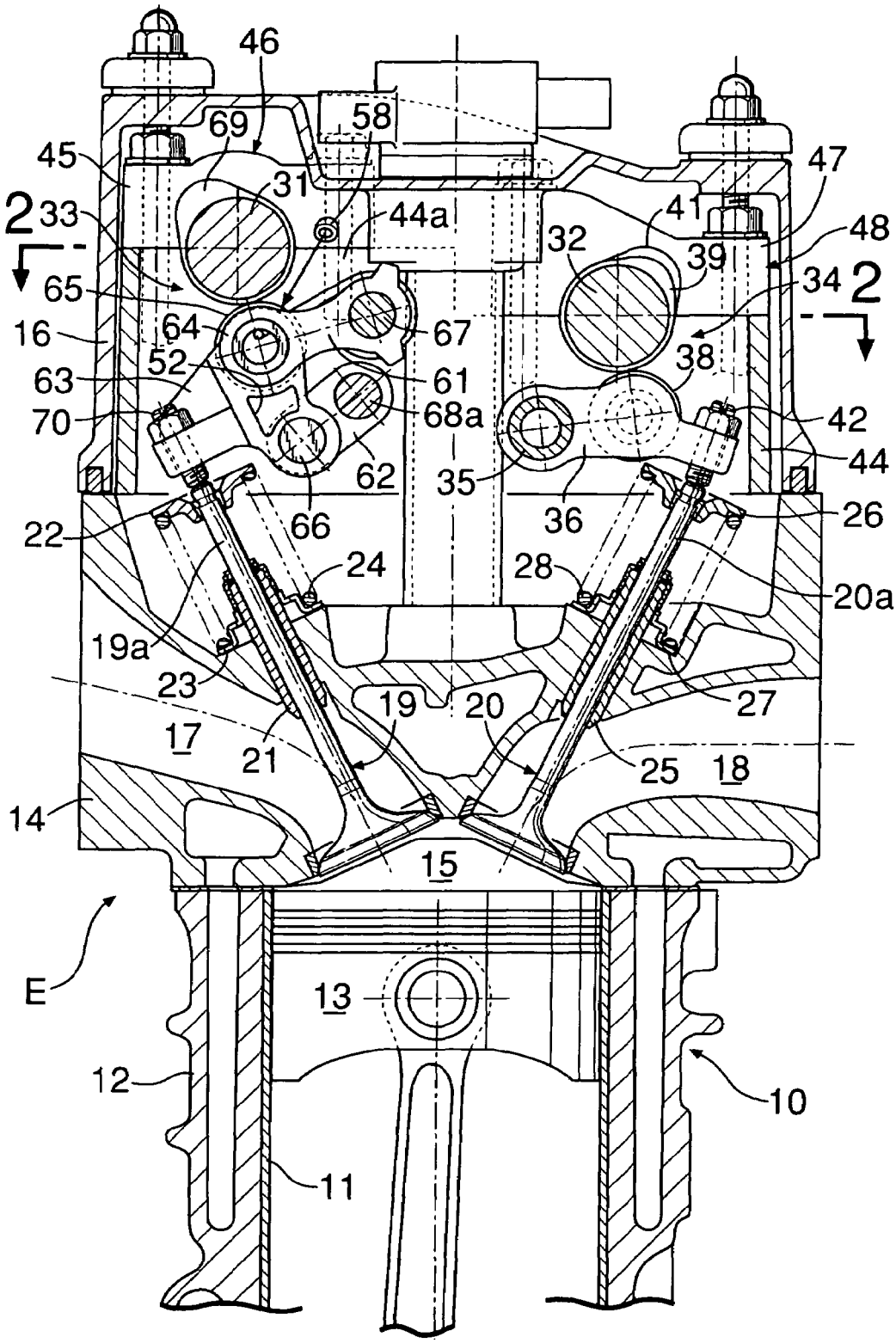
FIG. 1 is a partial vertical sectional view of an engine according to a first embodiment of the present invention, taken along line 1-1 in FIG. 2. (Embodiment 1)

10 Engine body
19 Intake valve serving as an engine valve
44*a* Support wall
49, 50 Connecting holes
51 Concave portion
52, 117, 118 Lightening portions
54, 122 Torsion spring serving as an interposition
61, 112 First link arms
61*a*, 112*a* Connecting portions
62, 113 Second link arms
63, 111 Rocker arms
63*a*, 111*a* Valve connecting portions
63*b*, 111*b* First support portions
63*c*, 111*c* Second support portions
63*d* Connecting wall
64, 66 Connecting shafts
65, 114 Rollers serving as cam abutting portions
67, 119 Support shafts
68*a*, 134 Movable support shafts
69 Valve operating cam
70 Tappet screw
72 Actuator motor serving as driving means
E Engine
L Tangent

Best Mode for Carrying Out the Invention

Mode for carrying out the present invention will be described based on embodiments of the invention shown in the accompanied drawings.

EMBODIMENT 1

FIGS. 1 to 11 show a first embodiment of the present invention.

First, in FIG. 1, an engine body 10 of an in-line multi-cylinder engine E comprises a cylinder block 12 with cylinder bores 11 in the interior, a cylinder head 14 joined to a top face of the cylinder block 12, and a head cover 16 joined to a top face of the cylinder head 14. Pistons 13 are slidably fitted in the cylinder bores 11. Combustion chambers 15 facing tops of the pistons 13 are formed between the cylinder block 12 and cylinder head 14.

The cylinder head 14 is equipped with intake ports 17 and exhaust ports 18 which can communicate with combustion chambers 15. The intake ports 17 are opened and closed by a pair of intake valves 19, 19 which are engine valves while the exhaust ports 18 are opened and closed by a pair of exhaust valves 20, 20. Each intake valve 19 has a stem 19*a* slidably fitted in a valve guide 21 provided in the cylinder head 14, and is biased in a valve closing direction by a valve spring 24 installed between a spring seat 22 provided at the upper end of the stem 19*a* and a spring seat 23 abutted by the cylinder head 14. Each exhaust valve 20 has a stem 20*a* slidably fitted in a valve guide 25 provided in the cylinder head 14 and is biased in a valve closing direction by a valve spring 28 installed between a spring seat 26 provided at the upper end of the stem 20*a* and a spring seat 27 abutted by the cylinder head 14.

Figure 2:
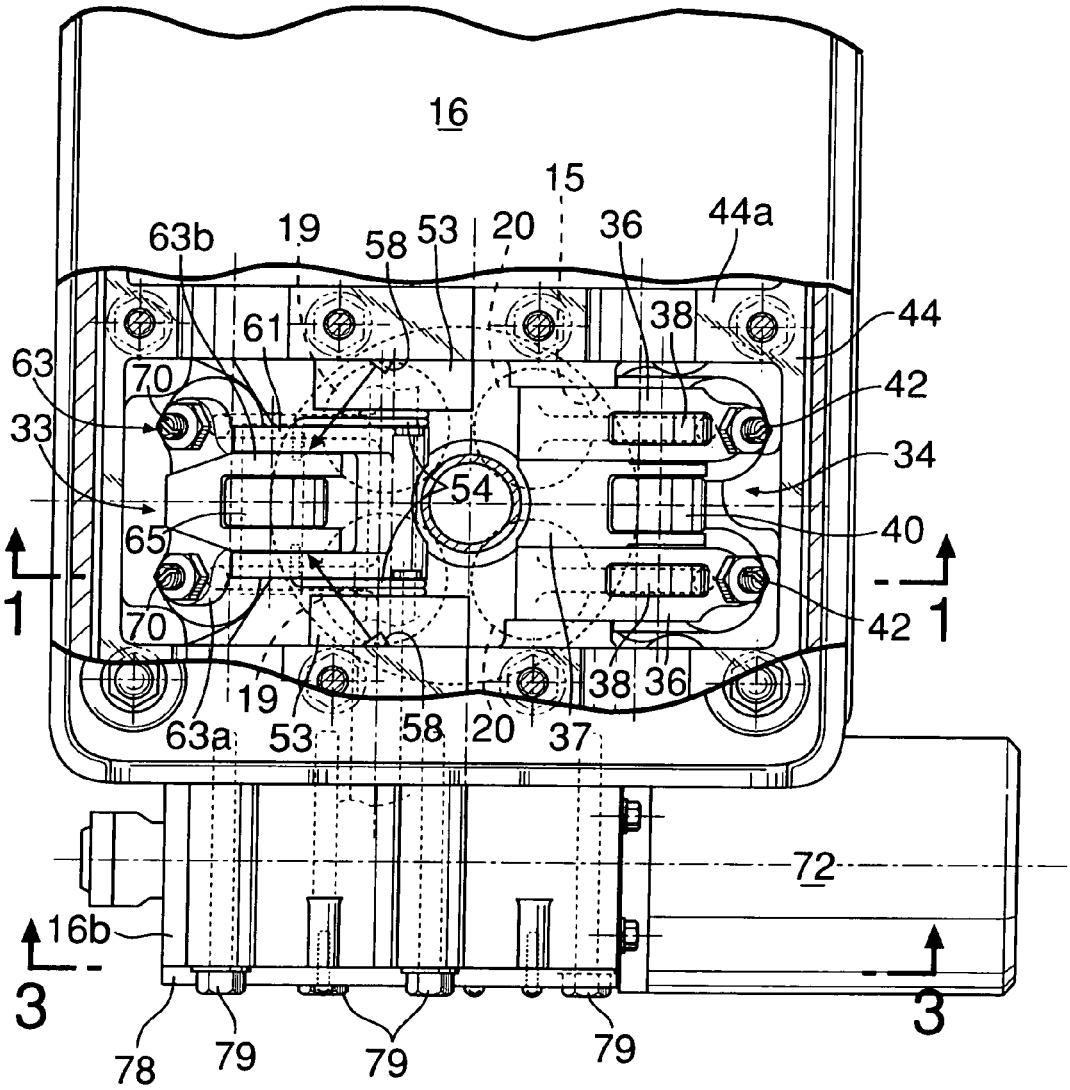
FIG. 2 is a sectional view taken along line 2-2 in FIG. 1. (Embodiment 1)

Referring also to FIG. 2, the cylinder head 14 integrally comprises a holder 44 which has supporting walls 44*a* placed on opposite sides of each cylinder. Caps 45 and 47 are coupled to each supporting wall 44*a* to form an intake cam holder 46 and exhaust cam holder 48 in conjunction. Consequently, an intake camshaft 31 is rotatably supported by the intake cam holders 46 while an exhaust camshaft 32 is rotatably supported by the exhaust cam holders 48. The intake valves 19 are driven by the intake camshaft 31 via variable lifting mechanism 33. The exhaust valves 20 are driven by the exhaust camshaft 32 via variable valve timing/lifting means 34.

The variable timing/lifting means 34 which drives the exhaust valves 20 is well-known, and will only be outlined here. A pair of low-speed rocker arms 36, 36 and one high-speed rocker arm 37 are pivotably supported at their first ends on an exhaust rocker arm shaft 35 supported by holding walls 44*a* of exhaust cam holders 48. Two low speed cams 39, 39 provided on the exhaust camshaft 32 abut against rollers 38, 38 axially supported in intermediate parts of the low-speed rocker arms 36, 36. A high speed cam 41 provided on the exhaust camshaft 32 abuts against a roller 40 axially supported in an intermediate part of the high-speed rocker arm 37. Tappet screws 42 which abut against the upper ends of the stems 20*a* of the exhaust valves 20 are screwed into the second ends of the low speed rocker arms 36 in such a way as to allow their advance/retract position to be adjusted.

The low speed rocker arms 36, 36 and the high speed rocker arm 37 can be connected and disconnected by hydraulic control. When the engine E is running at low speed, if the low speed rocker arms 36, 36 and the high speed rocker arm 37 are disconnected, the low speed rocker arms 36, 36 are driven by the corresponding low speed cams 39, 39. Consequently, the exhaust valves 20, 20 are opened and closed with a low valve lift and a low opening angle. On the other hand, when the engine E is running at high speed, if the low speed rocker arms 36, 36 and the high speed rocker arm 37 are connected, the high speed rocker arm 37 is driven by the corresponding high speed cam 41. Consequently, the exhaust valves 20, 20 are opened and closed with a high valve lift and a high opening angle by the low speed rocker arms 36, 36 coupled to the high speed rocker arm 37. In this way, the valve lift and valve timing of the exhaust valves 20, 20 are controlled at two levels by the variable timing/lifting means 34.

Now, the structure of the variable lifting mechanism 33 will be described by referring also to FIGS. 3 to 7. The variable lifting mechanism 33 comprises an intake rocker arm 63 having a roller 65 serving as a cam abutting portion which abuts against an intake valve operating cam 69 provided on the intake cam shaft 31, a first link arm 61 having a first end turnably connected to the intake rocker arm 63 and a second end turnably supported at a fixed position of the engine body 10, and a second link arm 62 having a first end turnably connected to the intake rocker arm 63 and a second end turnably used by a displaceable movable support shaft 68*a*.

The intake rocker arm 63 is provided at its first end with a valve connecting portion 63*a* into which tappet screws 70, 70 are screwed in such a way as to allow advance/retract positions of the screws to be adjusted; the tappet screws 70, 70 abut against the upper ends of the stems 19*a* of the pair of intake valves 19 from above. The second end of the intake rocker arm 63 is formed into a general U shape, opening in opposition to the intake valves 19. The second end of the intake rocker arm 63 is provided with a first support portion 63*b* to which a first end of the first link arm 61 is turnably connected and a second support portion 63*c* to which a first end of the second link arm 61 is turnably connected; the second support portion 63*c* is placed below the first support portion 63*b*. Further, a roller 65 is placed so as to be sandwiched between linear portions of a generally U-shaped first support portion 63*b*; the roller 65 serves as a cam-abutting portion placed in rolling contact with the intake valve operating cam 69 of the intake cam shaft 31. The roller 65 is axially supported by the first support portion 63*b* coaxially with a first end connecting portion of the first link arm 61.

Further, the intake rocker arm 63 is formed so that the valve connecting portion 63*a* have a width larger than that of the remaining part in a direction along a turning axis of the intake valve operating cam 69. The first and second support portions 63*b* and 63*v* are formed to have the same width.

The first link arm 61 is formed into a substantial U shape with a pair of first connecting portions 61*a*, 61*a* which sandwiches the intake rocker arm 63 between them, a cylindrical fixed support portion 61*b*, and a pair of arm portions 61*c* which link the first connecting portions 61*a*, 61*a* and the fixed support portion 61*b*.

The first connecting portions 61*a*, 61*a* at the first end of the first link arm 61 are turnably connected to the first support portion 63*b* of the intake rocker arm 63 via a cylindrical first connecting shaft 64 fixedly inserted into a first connecting hole 49 formed in the first support portion 63*b* of the intake rocker arm 63. The roller 65 is also axially supported by the first support portion 63*b* via a needle bearing 60 and the first connecting shaft 64. Further, an outer flank of that part of the first support portion 63*b* which is opposite the intake cam shaft 31 overlaps with outer flanks of the first connecting portions 61*a*, 61*a* of the first link arm 61, as viewed laterally; an arc shape is thus formed around the axis of the first connecting shaft 64.

The second link arm 62 is placed below the first link arm 61. The second link arm 62 has a first connecting portion 62*a* at its first end and a movable support portion 62*b* at its second end. A second connecting portion 62*a* is placed so as to be sandwiched between linear portions of the generally U-shaped second support portion 63*b*. A second support portion 63*c* is provided not only with the first connecting hole 49 of the first support portion 63*b* but also with a second connecting hole 50 located by the side of the first connecting hole 49 in a direction in which both intake valves 19 are opened and closed, that is, in the vertical direction. The second connecting portion 62*a* is turnably connected to the second support portion 63*c* via a second connecting shaft 66 fixedly inserted into the second connecting hole 50.

The first end of the intake rocker arm 63 having the roller 65 above the second end abutting against the intake valve operating cam 69 is interlocked with and connected to the pair of intake valves 19. The first connecting portions 61*a*, 61*a* provided at the first end of the upper first link arm 61 and the second connecting portion 62*a* provided at the first end of the second link arm 62, located below the first link arm 61, are vertically arranged in parallel and relatively turnably connected to the second arm of the intake rocker arm 63.

The intake rocker arm 63 is provided integrally with a pair of connecting walls 63*d* that links the generally U-shaped first and second support portions 63*b* and 63*c* together. The connecting walls 63*d* are formed so as to connect the first and second support portions 63*b* and 63*c* together; the connecting walls 63*d* are at least partly arranged opposite the intake valves 19 with respect to a tangent L which contacts with outer edges of the first and second connecting holes 49 and 50 on the side of both intake valves 19.

Concave portions 51 are formed in the connecting walls 63*d* so as to lie opposite the movable support shaft 68*a* when the movable support portion 62*b* at the second end of the second link arm 62 is closest to the intake rocker arm 63. Moreover, lightening portions 52 are formed in the connecting walls 63*d* so as to be recessed from an outer surface to inner surface of each wall.

A fixed support portion 61*b* at the second end of the first link arm 61 is turnably supported, via the fixed support shaft 67, by the support walls 44*a* arranged on the opposite sides of the fixed support portion 61*b* so as to constitute a lower part of the intake cam holder 46 provided in the engine body 10. The fixed support shaft 67 is fixedly supported by the opposite support walls 44*a*.

Figure 6:
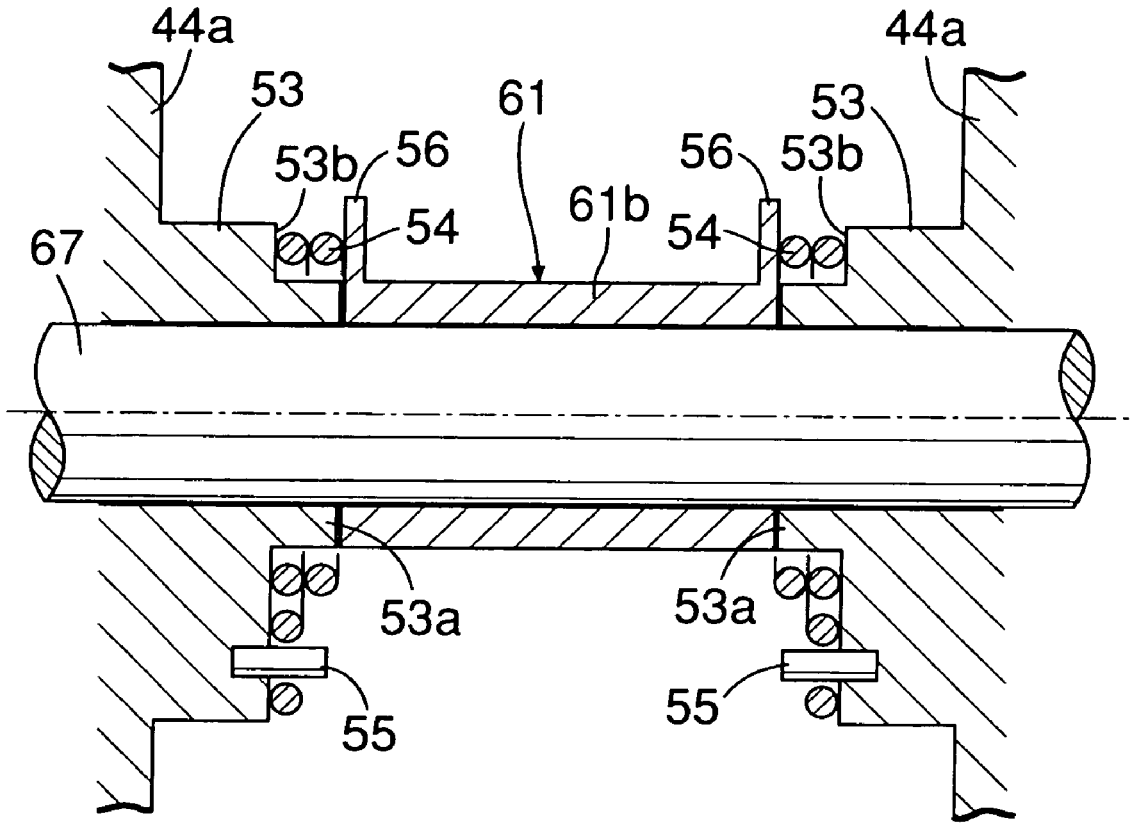
FIG. 6 is an enlarged sectional view taken along line 6-6 in FIG. 4. (Embodiment 1)
Figure 7:
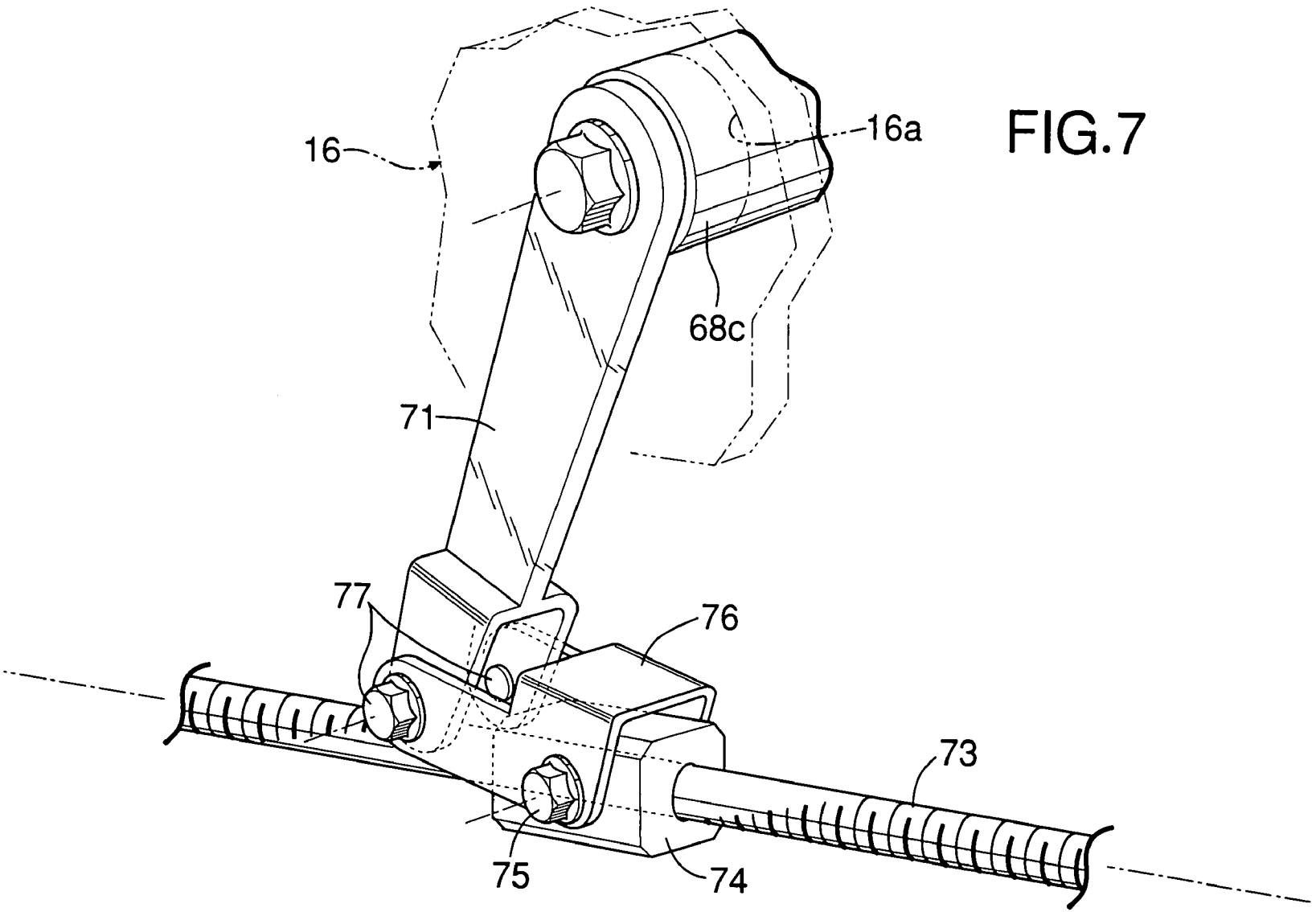
FIG. 7 is a view of a part shown by arrow 7 in FIG. 3. (Embodiment 1)

Referring particularly to FIG. 6, a pair of support bosses 53, 53 stick out integrally from the support walls 44*a* so as to project toward the fixed support portion 61*b* of the first link arm 61 in an axial direction. Each of the support bosses 53 is provided with a smaller-diameter shaft portion 53*a* which can slidably contact with the opposite end faces of the fixed support portion 61*b* and a step portion 53*b* located opposite and away from the opposite end faces of the fixed support portion 61*b* so as to surround a proximal end of the smaller-diameter shaft portion 53*a*. The fixed support shaft 67 is fixedly supported by the support bosses 53 so as to coaxially penetrate the smaller-diameter shaft portions 53*a*.

Both intake valves 19 are biased by the valve springs 24 in the valve closing direction. While the intake rocker arm 63 is driving, in the valve opening direction, both intake valves 19 biased in the valve closing direction, the valve springs 24 cause the roller 65 of the intake rocker arm 63 to abut against the intake valve operating cam 69. However, while the intake valves 19 are closed, the spring force of the valve springs 24 does not act on the intake rocker arm 63. Consequently, the roller 65 may leave the intake valve operating cam 69 to reduce the accuracy with which the valve lift amount is controlled when the intake valves 19 are to be slightly opened. Thus, a torsion spring 54 is provided separately from the valve spring 24; the torsion spring 54 is an interposition placed between each of the opposite surfaces of the fixed support portion 61*b* at the second end of the first link arm 61 and the support boss 53 sticking out from each of the support walls 44*a* arranged on the opposite sides of the fixed support portion 61*b*. The torsion spring 54 biases the intake rocker arm 63 in a direction in which the roller 65 abuts against the intake valve operating cam 69.

The torsion spring 54 is placed so as to surround the fixed support shaft 67 via the smaller-diameter shaft portion 53*a* of the support boss 53. The torsion spring 54 is provided between the engine body 10 and the intake rocker arm 63. In other words, a first end of the torsion spring 54 surrounding the smaller-diameter shaft portion 53*a* is engaged with the locking pin 55 installed on the step portion 53*b* of the support boss 53. A second end of the torsion spring 54 is inserted into and engaged with the hollow first connecting shaft 64 operating integrally with the intake rocker arm 63.

The fixed support portion 61*b* at the second end of the first link arm 61 is formed like a cylinder so that its outer periphery is placed inward of an outer periphery of each torsion spring 54 as viewed laterally, the rocker arm biasing spring being wound like a coil. A plurality of, for example, paired projecting portions 56 and 57 are provided away from each other in a circumferential direction so as to stick out from the opposite ends of the fixed support portion 61*b* in its axial direction. The projecting portions 56 and 57 serve to inhibit the torsion springs 54 from being laid down toward the fixed support portion 61*b*. The projecting portions 56 and 57 are arranged outside the operating range of the second link arm 62.

Oil jets 58 are fixedly placed in the engine body 10 as oil supply means to supply oil to the upper one of the first and second connecting shafts 64 and 66 arranged at the second end of the intake rocker arm 63 vertically in parallel so as to connect the first connecting portions 61*a* and second connecting portion 62*a* together, which are provided at the first ends of the first and second link arm 61 and 62. In the present embodiment, the oil jets 58 are fixedly attached to caps 45 of the intake cam holders 46, provided in the engine body 10, to supply oil to the first connecting shaft 64, one of the first and second connecting shafts 64 and 66.

Further, the first support portion 63*b* is provided in the upper part of the second end of the intake rocker arm 63; the first support portion 63*b* is formed like a general U shape so as to sandwich the roller 65 between its linear portions. The first connecting portions 61*a* of the first link arm 61 are turnably connected to the first support portion 63*b* via the first connecting shaft 64, which axially supports the roller 65. The oil jets 58 are disposed in the caps 45 so as to supply oil to mating surfaces of the first connecting portions 61*a* of the first link arm 61 and the first support portion 63*b*.

A crank member 68 is provided with the movable support shaft 68*a* turnably supporting the movable support portion 62*b* provided at the second end of the second link arm 62. The crank member 68 is provided at the opposite ends of a connecting plate 68*b* placed on a plane parallel to a plane in which the second link arm 62 operates and at right angles so that the movable support shaft 68*a* and the support shaft 68*c* stick out in opposite directions. The support shaft 68*c* is rotatably supported in a support hole 16*a* formed in the head cover 16 in the engine body 10.

Figure 4:
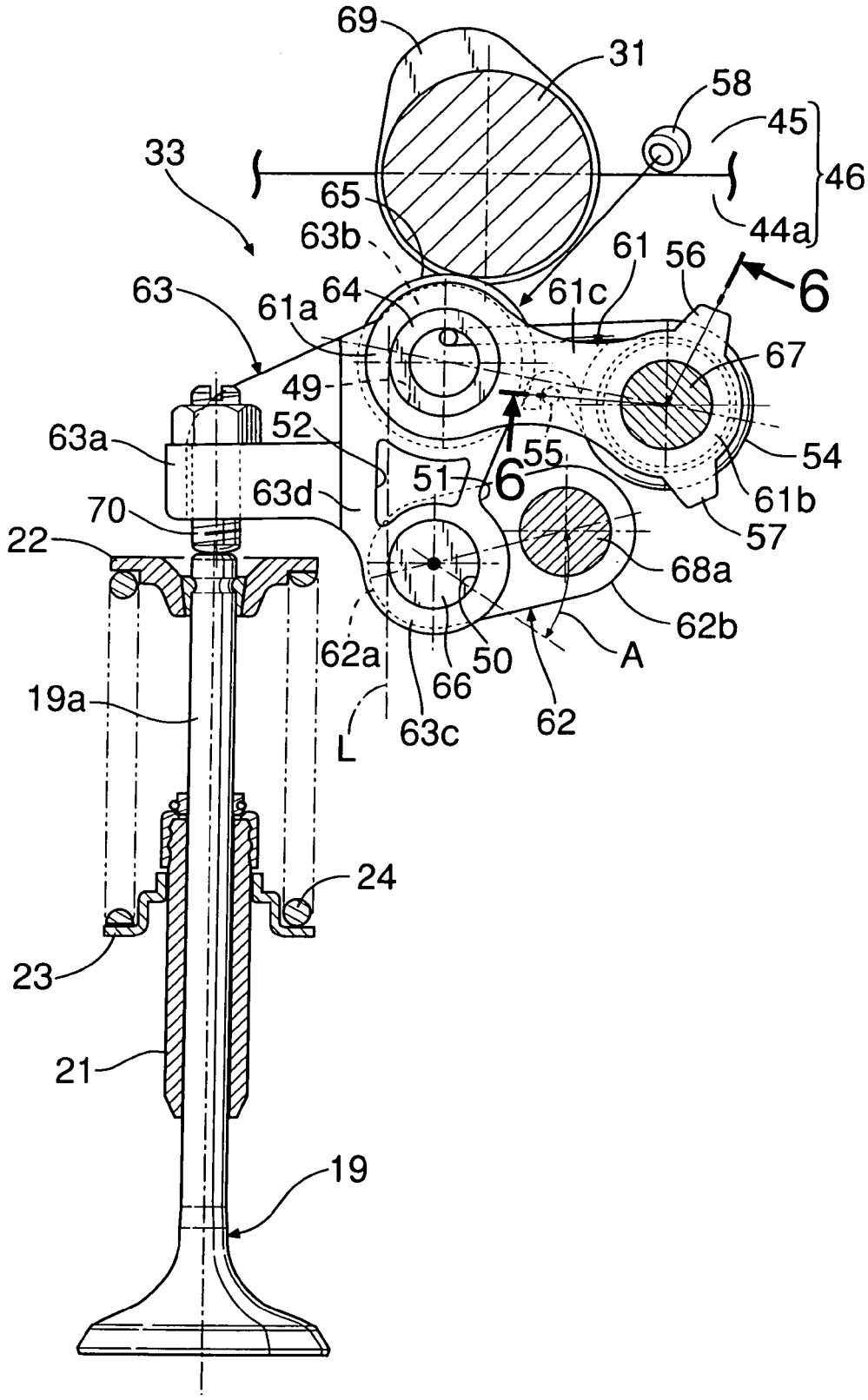
FIG. 4 is a side view of a variable lifting mechanism. (Embodiment 1)
Figure 5:
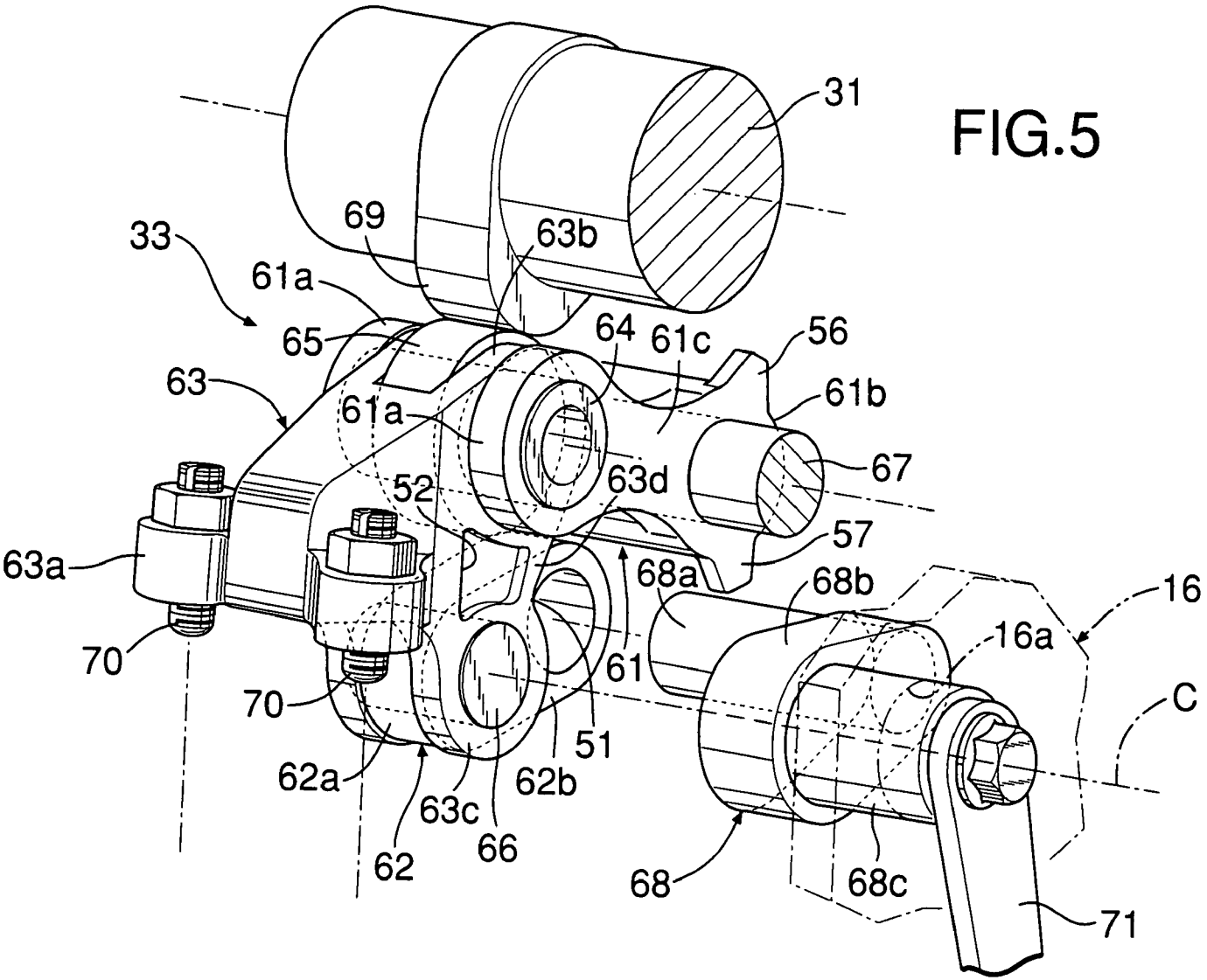
FIG. 5 is an exploded perspective view of the variable lifting mechanism. (Embodiment 1)

When the intake rocker arm 63 is at the raised position shown in FIG. 4, that is, when the intake valves 19 are in a closed state, the spindle 68*c* of the crank member 68 is placed coaxially with an axis C of a second connecting shaft 66, which pivotably supports the lower part of the intake rocker arm 63 (see FIG. 5). Therefore, when the crank member 68 swings around the axis of the spindle 68*c*, the movable support shaft 68*a* moves on an arc A (see FIG. 4) which has its center at the spindle 68*c*.

The spindle 68*c* of the crank member 68 sticks out from the support hole 16*a* in the head cover 16. A control arm 71 is fixed to the tip of the spindle 68*c* and driven by an actuator motor 72 mounted on an outer wall of the cylinder head 14 and serving as drive means. That is, a nut member 74 meshes with a threaded shaft 73 rotated by the actuator motor 72. A first end of a connecting link 76 is pivotably supported on the nut member 74 via a pin 75. The second end is connected to the control arm 71 via pins 77, 77. Therefore, when the actuator motor 72 is operated, the nut member 74 moves along the rotating threaded shaft 73. Further, the crank member 68 is caused to swing around the spindle 68*c* by the control arm 71 connected to the nut member 74 via the connecting link 76. Consequently, the movable support shaft 68*a* moves between the position shown in FIG. 8A and the position shown in FIG. 8B.

A rotational angle sensor 80 such as a rotary encoder is installed on an outer wall surface of the head cover 16. A first end of a sensor arm 81 is fixed to the tip of a sensor shaft 80*a* of the rotational angle sensor 80. A guide groove 82 is provided in the control arm 71 linearly extending along its length. A connecting shaft 83 mounted on a second end of the sensor arm 81 is slidably fitted in the guide groove 82.

The threaded shaft 73, nut member 74, pin 75, connecting link 76, pins 77, 77, control arm 71, rotational angle sensor 80, sensor arm 81, and connecting shaft 83 are housed within wall portions 14*a* and 16*b* sticking out from flanks of the cylinder block 14 and head cover 16. A cover 78 which covers end faces of the wall portions 14*a* and 16*b* is fixed to the wall portions 14*a* and 16*b* with bolts 79.

Figure 3:
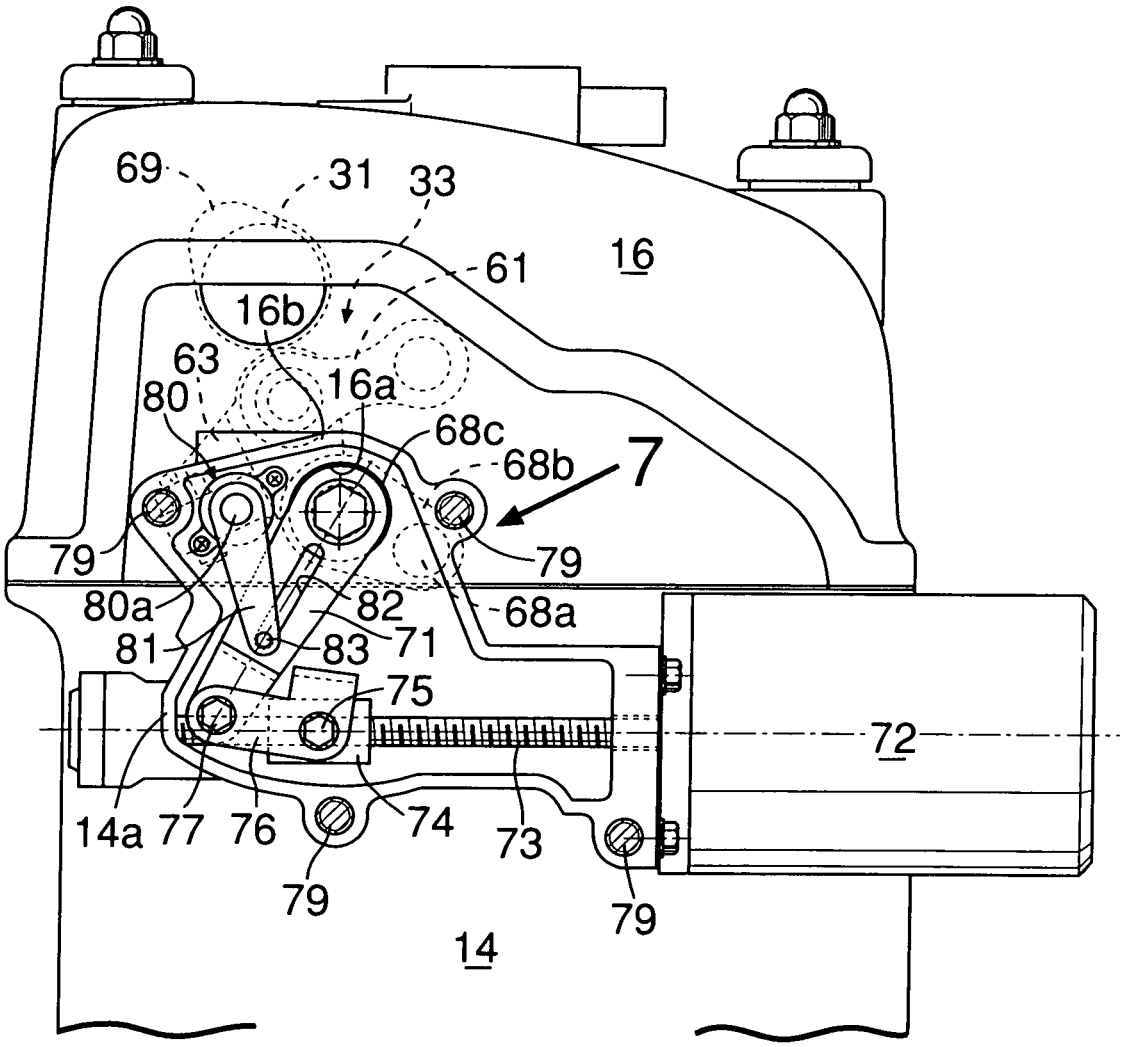
FIG. 3 is a sectional view taken along line 3-3 in FIG. 2. (Embodiment 1)
Figure 8A:
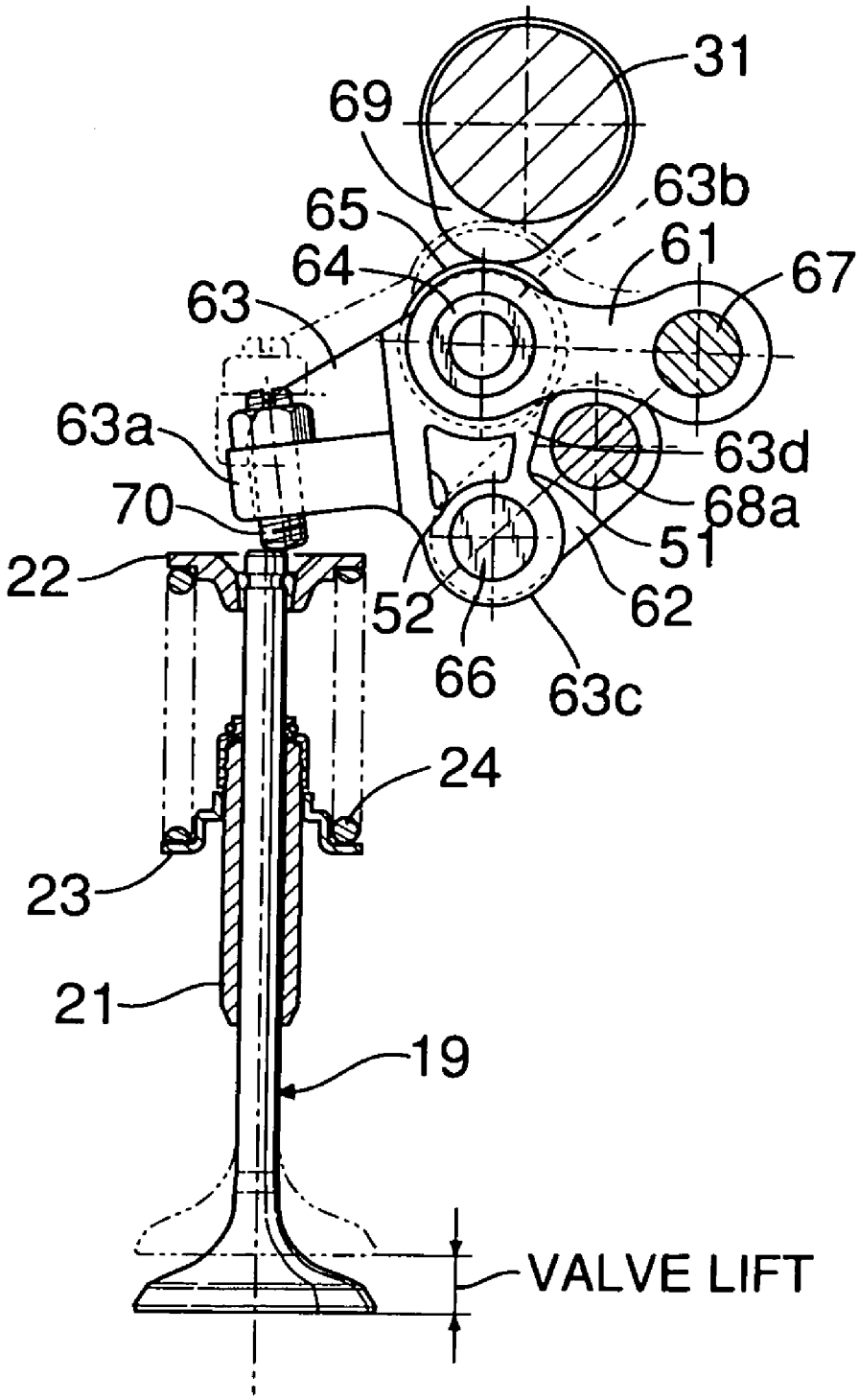
FIG. 8A is an explanatory diagram showing the operation of the variable lifting mechanism performed when a valve lift is high. (Embodiment 1)

In the variable lifting mechanism 33, when the control arm 71 is turned counterclockwise by the actuator motor 72 from the position indicated by the solid line in FIG. 3, the crank member 68 (see FIG. 5) connected to the control arm 71 turns counterclockwise. The movable support shaft 68*a* of the crank member 68 then ascends as shown in FIG. 8A. When the intake valve operating cam 69 mounted on the intake camshaft 31 pushes the roller 65 in this state, a four-bar link joining the fixed support shaft 67, first connecting shaft 64, second connecting shaft 68, and movable support shaft 68*a* deforms. This causes the intake rocker arm 63 to swing downward from the chain-line position to the solid-line position. The tappet screws 70, 70 then push the stems 19*a* of the intake valves 19. The intake valves 19 are thus opened with a high valve lift.

Figure 8B:
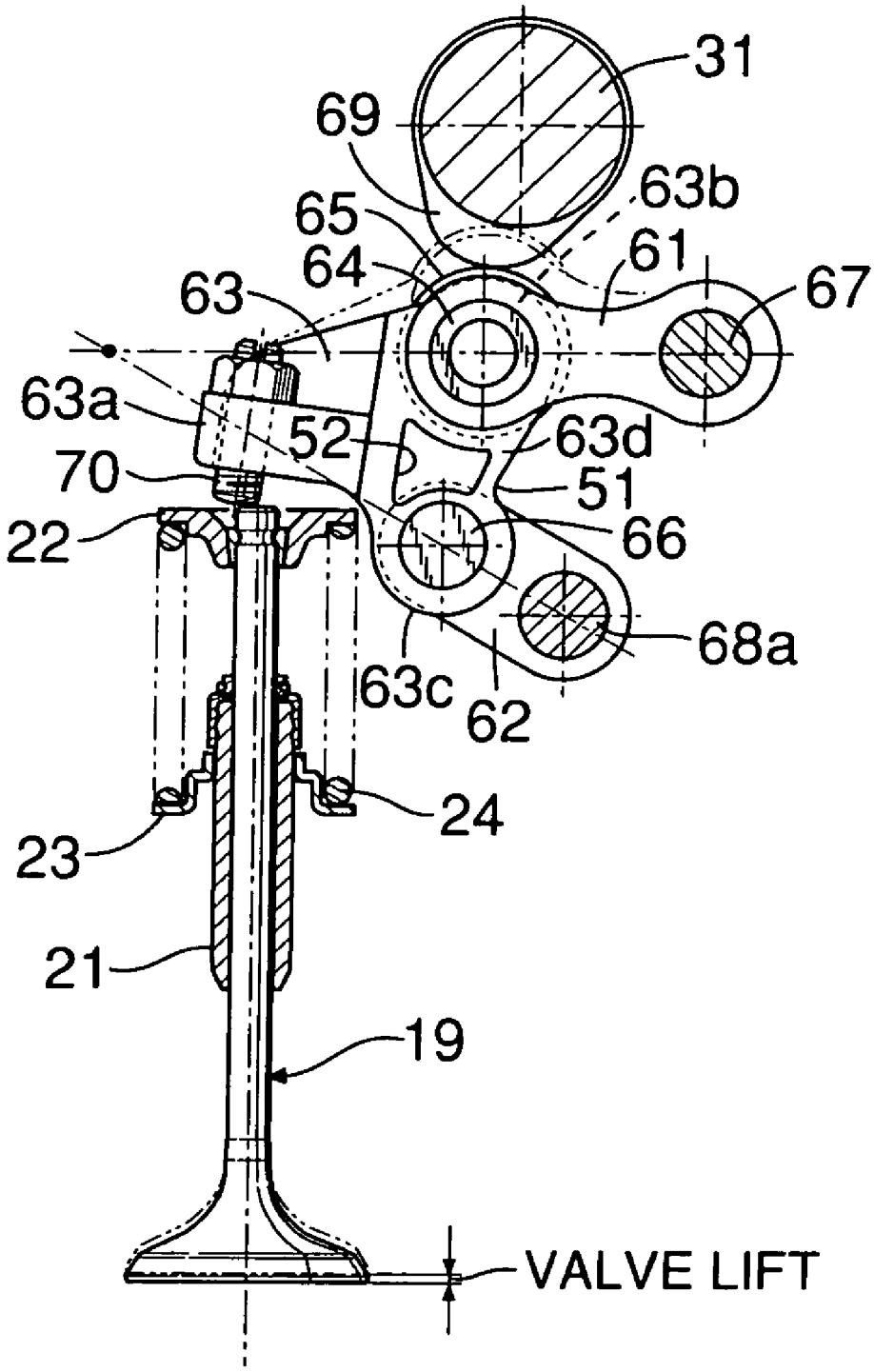
FIG. 8B is an explanatory diagram showing the operation of the variable lifting mechanism performed when a valve lift is low. (Embodiment 1)

When the control arm 71 is turned to the solid-line position in FIG. 3 by the actuator motor 72, the crank member 68 connected to the control arm 71 turns clockwise. The moveable support shaft 68*a* of the crank member 68 descends as shown in FIG. 8B. When the intake valve operating cam 69 mounted on the intake camshaft 31 pushes the roller 65 in this state, the four-bar link deforms. This causes the intake rocker arm 63 to swing downward from the chain-line position to the solid-line position. The tappet screws 70, 70 then push the stems 19*a* of the intake valves 19. The intake valves 19 are thus opened with a low valve lift.

Figure 9:
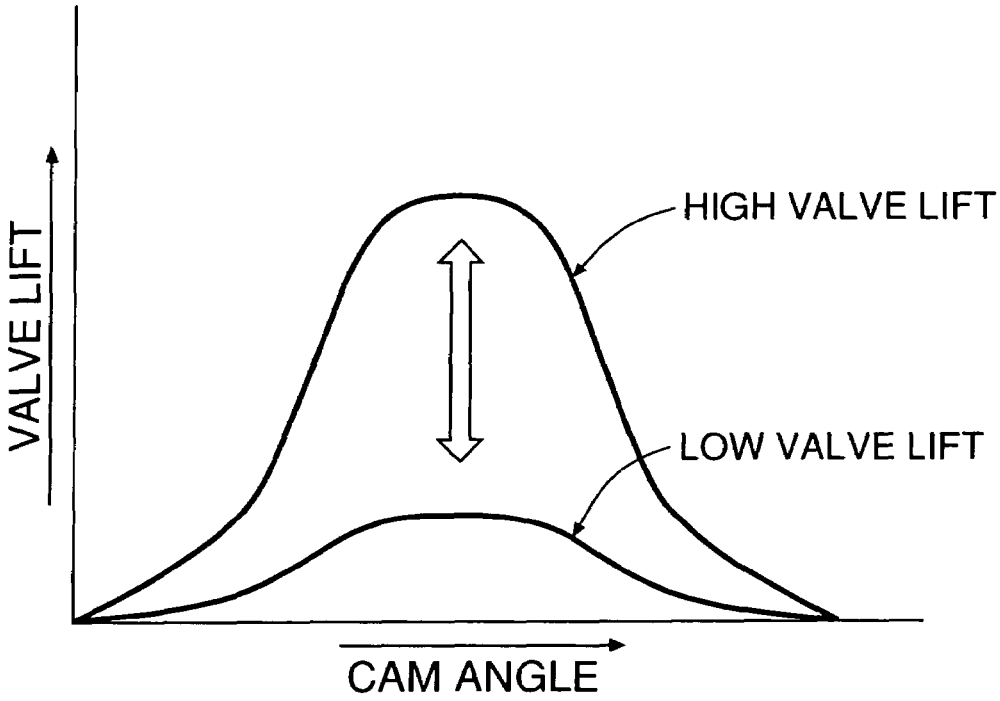
FIG. 9 is a diagram showing a lift curve of an engine valve. (Embodiment 1)

FIG. 9 is a diagram showing a lift curve of the intake valve 19. The opening angle with the high lift corresponding to FIG. 8A is the same as that with the low lift corresponding to FIG. 8B, and only the amount of lift has changed. In this way, the variable lifting mechanism 33 allows only the lift amount to be changed freely without changing the opening angle of the intake valves 19.

When changing the lift of the intake valves 19 by swinging the crank member 68 using the actuator motor 72, it is necessary to detect the magnitude of the lift, i.e., the rotational angle of the spindle 68*c* of the crank member 68 and feed this data back for use in controlling the actuator motor 72. To achieve this, the rotational angle sensor 80 detects the rotational angle of the spindle 68*c* of the crank member 68. To simply detect the rotational angle of the spindle 68*c* of the crank member 68, the rotational angle sensor 80 can be connected directly to the spindle 68*c*. However, since the intake efficiency changes greatly with only a slight change in the amount of lift in the low lift region, it is necessary to detect the rotational angle of the spindle 68*c* of the crank member 68 accurately and feed this data back for use in controlling the actuator motor 72. On the other hand, in a high lift region, since the intake efficiency does not change greatly even when the amount of lift changes to some extent, high accuracy is not required to detect the rotational angle.

Figure 10:
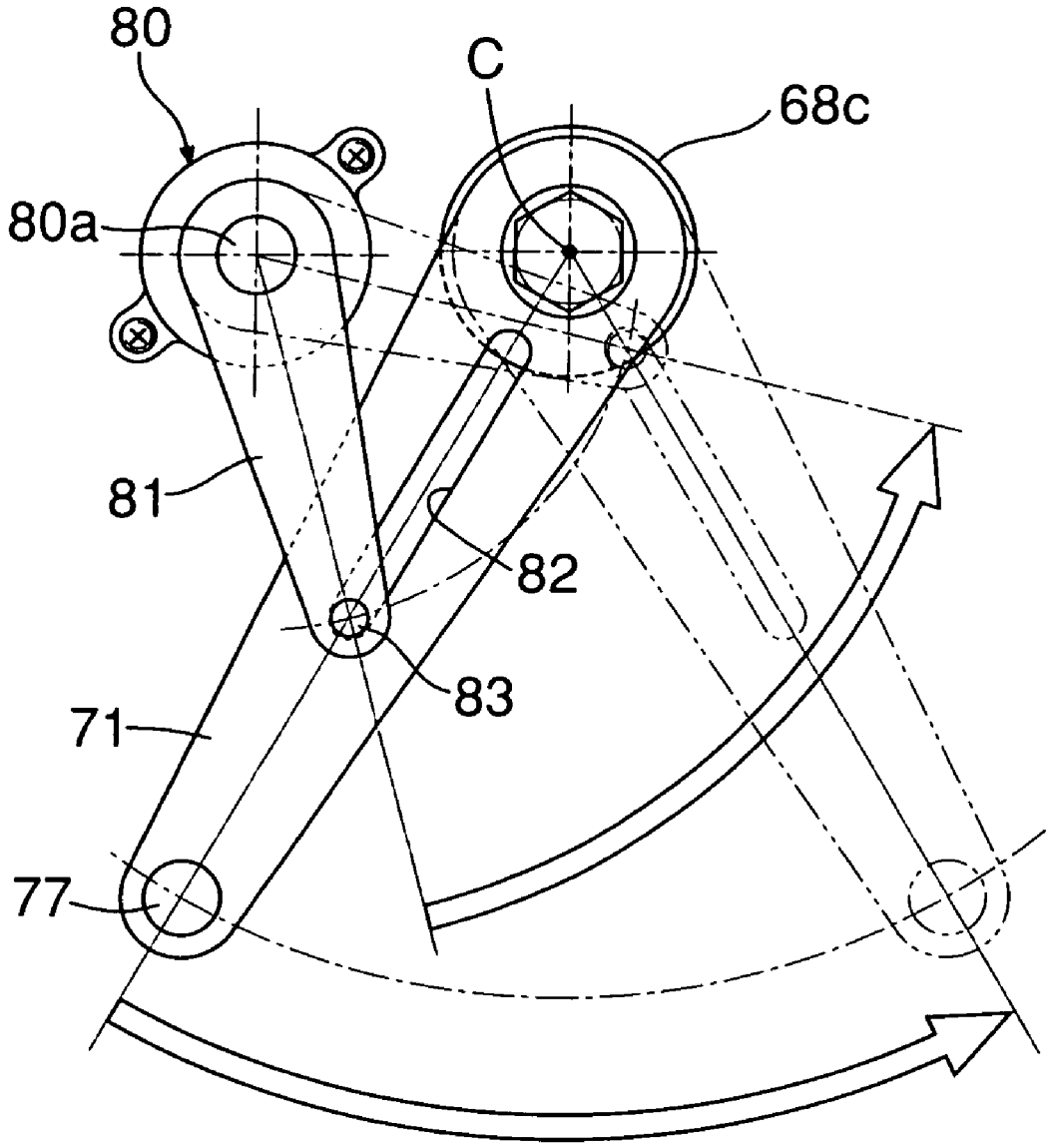
FIG. 10 is an enlarged view of an essential part of FIG. 3. (Embodiment 1)

The position of the control arm 71 indicated by the solid line in FIG. 10 corresponds to the low lift region. The position of the control arm 71 indicated by the chain line in the anticlockwise direction away from the low lift region corresponds to the high lift region. In the low lift region, since the connecting shaft 83 of the sensor arm 81 fixed to the sensor shaft 80*a* of the rotational angle sensor 80 is engaged with the tip side (the side farther from the axis C) of the guide groove 82 of the control arm 71, even a slight swing of the control arm 71 results in a large swing of the sensor arm 81. This magnifies the ratio of the rotational angle of the sensor shaft 80*a* relative to the rotational angle of the crank member 68. The resolution of the rotational angle sensor 80 is thus enhanced to enable the rotational angle of the crank member 68 with high accuracy.

On the other hand, in the high lift region where the control arm 71 has swung to the position indicated by the chain line, since the connecting shaft 83 of the sensor arm 81 fixed to the sensor shaft 80*a* of the rotational angle sensor 80 is engaged with the base side (the side closer to the axis C) of the guide groove 82 of the control arm 71, even a large swing of the control arm 71 results in a slight swing of the sensor arm 81. This reduces the ratio of the rotational angle of the sensor shaft 80*a* relative to the rotational angle of the crank member 68. Consequently, the accuracy with which the rotational angle of the crank member 68 is detected decreases compared to the case where the lift is low.

Figure 11:
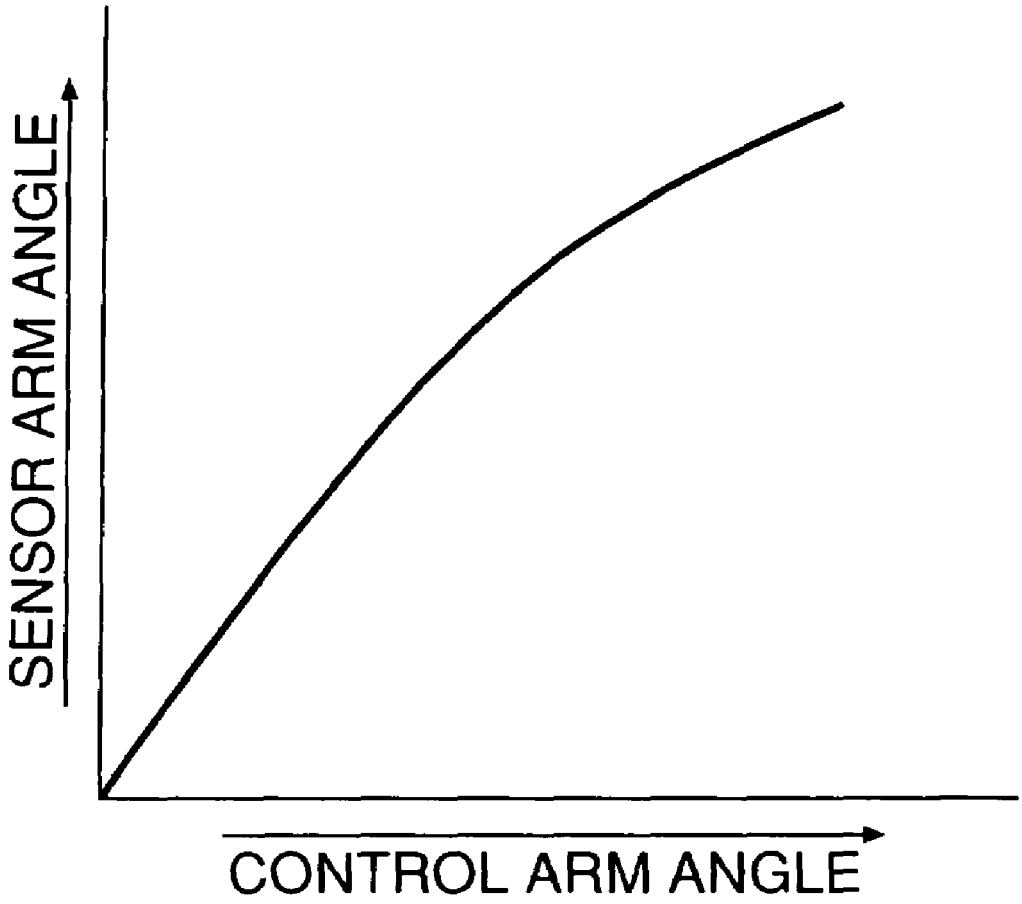
FIG. 11 is a graph showing the relationship between the rotational angle of a control arm and the rotational angle of a sensor arm. (Embodiment 1)

As is clear from the graph in FIG. 11, when the rotational angle of the control arm 71 increases from a low lift state to a high lift state, the detection accuracy is high at first. This is because at this point, the rate of increase in the angle of the sensor arm 81 is high. However, the rate of increase falls gradually, reducing the detection accuracy.

Thus, without an expensive rotational angle sensor with a high detection accuracy, by engaging the sensor arm 81 of the rotational angle sensor 80 with the guide groove 82 of the control arm 71, it is possible to ensure a high detection accuracy in a low lift state where such a detection accuracy is required. This contributes to cost reduction.

In this arrangement, one end (the end closer to the spindle 68*c*) of the control arm 71 and one end (the end closer to the rotational angle sensor 80) of the sensor arm 81 are placed in proximity to each other. Further, the guide groove 82 is formed at the end of the control arm 71. Accordingly, the sensor arm 81 can be made compact with its length reduced. Further, the formation of the guide groove 82 at the end of the control arm 71 reduces the distance from the axis C as well as the amount of travel in the circumferential direction of the guide groove 82. However, the length of the sensor arm 81 is also reduced to allow the sensor arm 81 to turn through a sufficient angle. This ensures the accuracy with which the rotational angle of the sensor 80 is detected.

Now, the operation of the first embodiment will be described. In the variable lifting mechanism 33 which continuously varies the lift amounts of the intake valves 19, the first connection portions 61*a*, 61*a* and second connecting portion 62*a*, attached to the first ends of the first link arm 61 and second link arm 62, respectively, are arranged in parallel and relatively turnably connected to the second end of the intake rocker arm 63 which has a valve connecting portion 63*a* interlocked and coupled to the pair of intake valves 19 at the first end. The fixed support portion 61*b* at the second end of the first link arm 61 is turnably supported by the fixed support shaft 67 of the engine body 10. The movable support portion 62*b* at the second end of the second link arm 62 is turnably supported by the displaceable movable support shaft 68*a*.

Thus, by varying the movable support shaft 68*a* continuously, it is possible to vary the lift amounts of the intake valves 19 continuously. Moreover, since the first ends of the first and second link arms 61 and 62 are turnably connected directly to the intake rocker arm 63, it is possible to reduce the size of the space in which the link arms 61 and 62 are arranged. This makes it possible to reduce the size of the valve operating system. Further, since power is transmitted directly from the intake valve operating cam 69 to the roller 65 of the intake rocker arm 63, it is possible to follow the intake valve operating cam 69 properly. Furthermore, the intake rocker arm 63 and the first and second link arms 61 and 62 can be placed at almost the same location along the axis of the intake camshaft 31. This enables the size of the valve operating system to be reduced in a direction along the axis of the intake cam shaft 31.

Moreover, in the intake rocker arm 63 having the valve connecting portion 73*a* into which the tappet screws 70, abutting against the pair of intake valves 19, are screwed so that their advance/retract positions can be adjusted, and the first and second support portions 63*b* and 63*c* to which the first ends of the first and second link arms 61 and 62 are turnably connected, the valve connecting portion 63*a* has a width larger than that of the remaining part in a direction along the turning axis of the intake valve operation cam 69. The width of the intake rocker arm 63 can thus be reduced in the direction along the turning axis of the intake valve operating cam 69. This also makes it possible to reduce the size of the valve operating system. In addition, the intake rocker arm 63 is formed so that the first and second support portions 63*b* and 63*c* have the same width. It is thus possible to make the intake rocker arm 63 compact in size, while simplifying the shape of this component.

Further, the first support portion 63*b*, provided on the intake rocker arm 63, is formed into a substantial U shape so as to sandwich the roller 65 between its linear portions. The roller 65 is rotatably supported by the first support portion 63*b*. Accordingly, the whole intake rocker arm 63, including the roller 65, can be made compact in size. Moreover, the paired first connecting portions 61*a* sandwiching the first support portions 63*b* between them are provided at the first end of the first link arm 61. Both first connecting portions 61*a* are turnably connected to the first support portion 63*b* via the first connecting shaft 64. The roller 65 is supported by the first support portion 63*b* via the first connecting shaft 64. Consequently, the common first connecting shaft 64 is used to turnably connect the first end of the first link arm 61 to the first support portion 63*b* and to allow the first support portion 63*b* to support the roller 65. This makes it possible to reduce the number of parts required and the size of the valve operating system.

The first and second connecting holes 49 and 50 are formed in the first and second support portions 63*b* and 63*c* of the intake rocker arm 63 so as to lie side by side in the direction in which the intake valves 19 are opened and closed; the first and second connecting shafts 64 and 66 to which the first ends of the first and second link arms 61 and 62 are turnably connected are inserted into the first and second connecting holes 49 and 50. The first and second support portions 63*b* and 63*c* are connected together by the connecting walls 63*d* at least partly arranged opposite both intake valves 19 with respect to the tangent L which contacts with the outer edges of the first and second connecting holes 49 and 50 on the side of both intake valves 19. This serves to enhance the rigidity of the first and second support portions 63*b* and 63*c*.

Further, the concave portions 51 are formed in the connecting walls 63*d* so as to sit opposite the second connecting position 62*a* when the second connecting portion 62*a* at the second end of the second link arm 62 is closest to the intake rocker arm 63. Accordingly, the second connecting portion 62*a* of the second link arm 62 can be displaced to a position where it is as close to the intake rocker arm 63 as possible. This makes it possible to set the maximum lift amount of the intake valve 19 at as large a value as possible while reducing the size of the valve operating system.

Moreover, the lightening portions 52 are formed in the connecting walls 63*d*. This suppresses an increase in the weight of the intake rocker arm 63, while allowing the rigidity to be enhanced using the connecting walls 63*d*.

The oil jets 58 are fixedly arranged in the engine body 10 to supply oil to the first connecting shaft 64, the upper one of the first and second connecting shafts 64 and 66, which connect the first ends of the first and second link arms 61 and 62 to the intake rocker arm 63. Oil infiltrating between the intake rocker arm 63 and the first link arm 61, the upper one of the first and second link arms 61 and 62, flows downward to infiltrate between the second link arm 62 and the intake rocker arm 63. Therefore, the simple lubricating structure with a reduced number of parts can be used to lubricate both connecting portions of the intake rocker arm 63 with the first and second link arms 61 and 62. This ensures that the vales operate smoothly.

Furthermore, the first support portion 63*b*, formed into a general U shape so as to sandwich the roller 65 between its linear portions, is provided on the intake rocker arm 63. The first connecting portion 61*a* at the first end of the first link arm 61 is turnably connected to the first support portion 63*b* via the first connecting shaft 64, which supports the roller 65. The oil jets 58 are disposed in the engine body 10 so as to supply oil to the mating surfaces of the first link arm 61 and first support portion 63*b*. It is thus possible to lubricate even the supported portion of the roller 65.

Moreover, the oil jets 58 are disposed in the caps 45 of the intake cam holders 46, provided in the engine body 10 so as to rotatably support the intake cam shaft 31 on which the intake valve operating cam 69 is provided. Consequently, by utilizing an oil path for lubricating between the intake cam shaft 31 and the intake cam holders 46, it is possible to supply a sufficient amount of oil through the oil jets 58 under a sufficiently high pressure.

The intake valves 19 are biased by the valve springs 24 in the valve opening direction. However, the intake rocker arm 63 is biased by the torsion springs 54, which is different from the valve springs 24, in the direction in which the roller 65 abuts against the intake valve operating cam 69. Accordingly, even when the intake valves 19 are closed, the roller 65 of the intake rocker arm 63 does not leave the intake valve operating cam 69. This improves the accuracy with which the valve lift amount is controlled when the intake valves 19 are slightly opened.

Further, the torsion springs 54 are coil-like torsion springs surrounding the fixed support shaft 67. This enables a reduction in the size of the space in which the torsion springs 58 are installed. Therefore, the size of the valve operating system can be reduced.

Moreover, the pair of support bosses 53, 53 supporting the fixed support shaft 67 is provided on the support walls 44*a* of the intake cam holders 46 in the engine body 10 so as to sandwich the second end of the first link arm 61 between the bosses. The torsion springs 54 are interposed between each support wall 44*a* and the second end of the first link arm 61 in the engine body 10 so as to surround the support bosses 53, 53. Consequently, the first link arm 61 can be easily positioned so that the torsion springs 54 can absorb the dimensional tolerance between the first link arm 61 and the support walls 44*a*. Furthermore, the torsion springs 54 can be arranged in a smaller space so as to avoid the adverse effect of the contraction of the torsion springs 54 on the fixed support shaft 67, while using the pair of support bosses 53, 53 to regulate the movement of the fixed support portion 61*b* at the second end of the first link arm 61.

The cylindrical fixed support portion 61*b* is provided at the second end of the first link arm 61; the outer periphery of the fixed support portion 61*b* is located inward of the outer periphery of each torsion spring 54 as viewed laterally. The fixed support portion 61*b* is turnably supported by the fixed support shaft 67. However, the plurality of projecting portions 56, 57 are provided at the axial opposite ends of the fixed support portion 61*b* at intervals in the circumferential direction so as to stick out from the axial opposite ends; the projecting portions 56, 57 inhibit the torsion springs 54 from being laid down toward the fixed support portion 61*b*. Therefore, it is possible to prevent the torsion springs 54 from being laid down as described above, while suppressing an increase in the size of the fixed support portion 61*b*. The supporting rigidity of the fixed support portion 61*b* can therefore be improved.

Moreover, the projecting portions 56, 57 are arranged outside the operating range of the second link arm 62. Accordingly, even though the projecting portions 56, 57 are provided on the fixed support portion 61*b*, the second link arm 62 can be provided with a sufficient operating range.

Moreover, the variable lifting mechanism 33 is equipped with the crank members 68 composed of the movable support shaft 68*a* and the support shaft 68*c* having an axis parallel to the movable support shaft 68*a*; the movable support shaft 68*a* and the support shaft 68*c* stick out from the opposite ends of the connecting plate 68*b*. The support shaft 68*c* is turnably supported by the head cover 16 in the engine body 10. Accordingly, by turning the crank member 68 around the axis of the support shaft 68*c*, it is possible to easily displace the movable support shaft 68*a*. This simplifies a mechanism that uses the actuator motor 72 to displace the movable support shaft 68*a*.

EMBODIMENT 2

FIGS. 12 to 19 show a second embodiment of the present invention. In these figures, parts corresponding to those of the first embodiment are denoted by the same reference numerals and characters.

Figure 12:
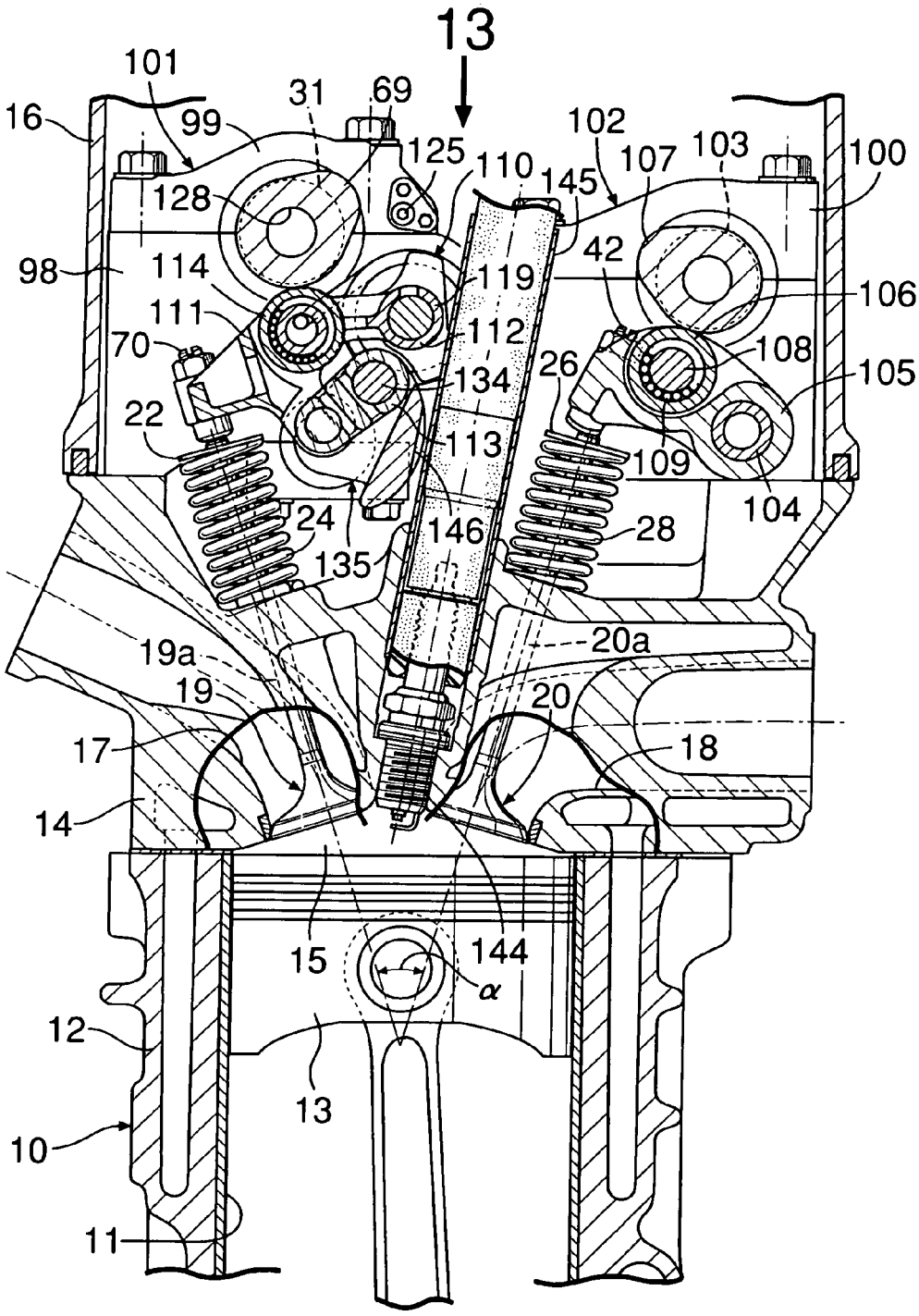
FIG. 12 is a partial vertical sectional view of an engine according to a second embodiment of the present invention, taken along line 12-12 in FIG. 13. (Embodiment 2)
Figure 13:
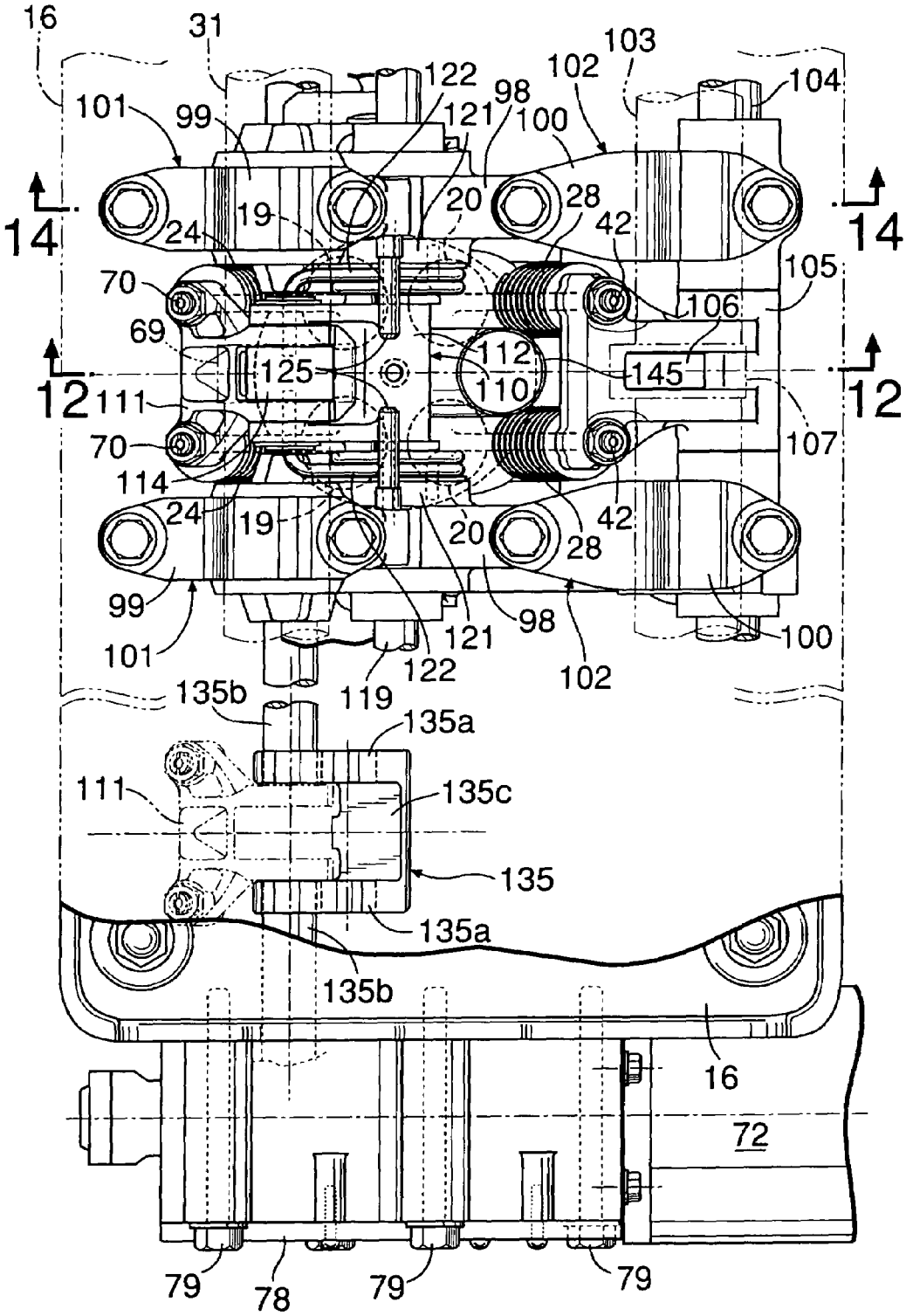
FIG. 13 is a view of a part shown by arrow 13 in FIG. 12. (Embodiment 2)
Figure 14:
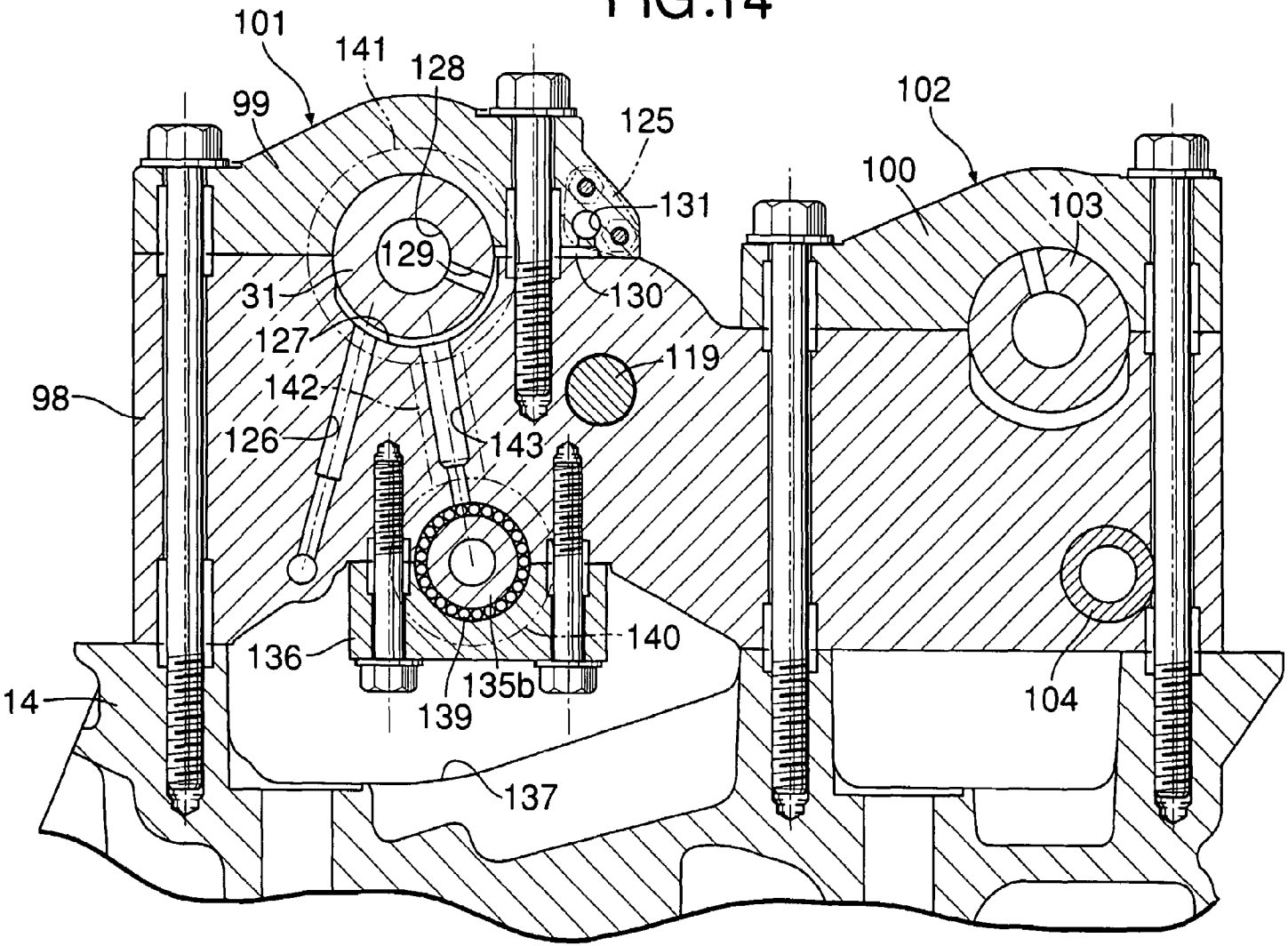
FIG. 14 is a sectional view taken along line 14-14 in FIG. 13. (Embodiment 2)

First, in FIGS. 12 to 14, upper holders 98 serving as support walls are tightened to the cylinder head 14 so as to line on the opposite sides of each cylinder. Caps 99, 100 are tightened to the upper holders 98 from above to constitute intake cam holders 101 and exhaust cam holders 102 in conjunction. The intake cam shaft 31 is rotatably supported between the upper holder 98 and the caps 99, constituting the intake cam holders 101 in conjunction. An exhaust cam holder 103 is rotatably supported between the upper holders 98 and the caps 100, constituting the exhaust cam holders 102.

An exhaust rocker shaft 104 supported by the upper holders 98 supports first ends of exhaust rocker arms 105 corresponding to the respective exhaust valves 20 so that the first ends can be swung. The pair of tappet screws 42 is screwed into a second end of each of the exhaust rocker arms 105 so that its advance/retract position can be adjusted. The tappet screws 42 abut against the upper ends of the stems 20*a* of the exhaust valves 20. The exhaust rocker arm 105 is provided with a shaft 108 in its intermediate portion, the shaft 108 extending parallel to the exhaust rocker shaft 104. A roller 106 is supported by the exhaust rocker arm 105 with a roller bearing 109 interposed between the roller 106 and the shaft 108; the roller 106 is in rolling contact with an exhaust valve operating cam 107 provided on the exhaust cam shaft 103.

Further, a swing support portion of the exhaust rocker arm 105, that is, the exhaust rocker shaft 104, is placed outside parts of the exhaust valves 20 which are interlocked and connected to the exhaust rocker arm 105, that is, the tappet screws 42.

The variable lifting mechanism 110 drives the exhaust valves 19 via the intake cam shaft 31. The variable lifting mechanism 110 comprises an intake rocker arm 111 having a roller 114 serving as a cam abutting portion which abuts against the intake valve operating cam 69 provided on the intake cam shaft 31, a first link arm 112 having a first end turnably connected to the intake rocker arm 111 and a second end turnably supported at a fixed position of the engine body 10, and a second link arm 113 having a first end turnably connected to the intake rocker arm 111 and a second end turnably supported by a displaceable movable support shaft 134.

Figure 15:
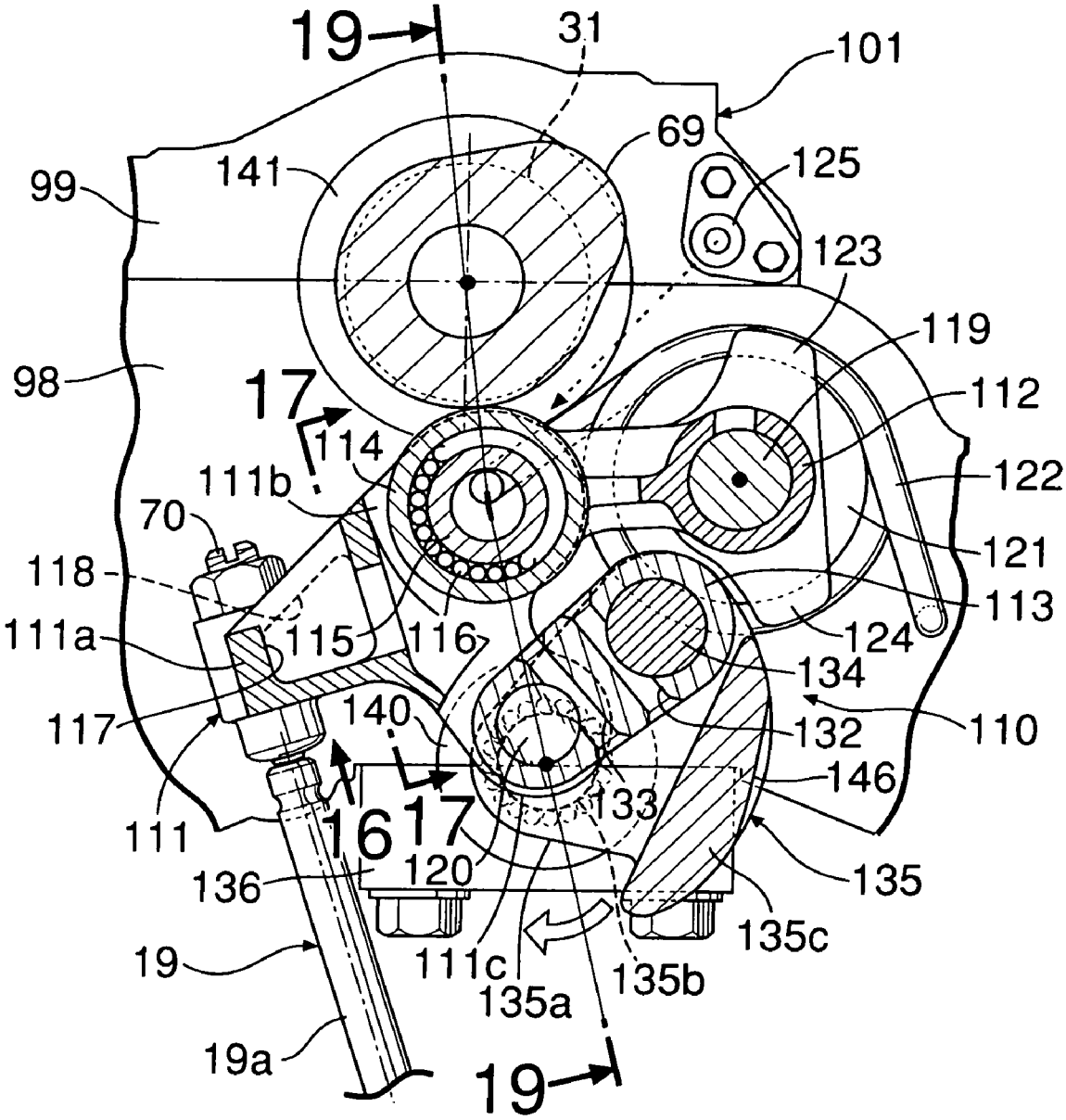
FIG. 15 is an enlarged view of an essential part of FIG. 12. (Embodiment 2)
Figure 16:
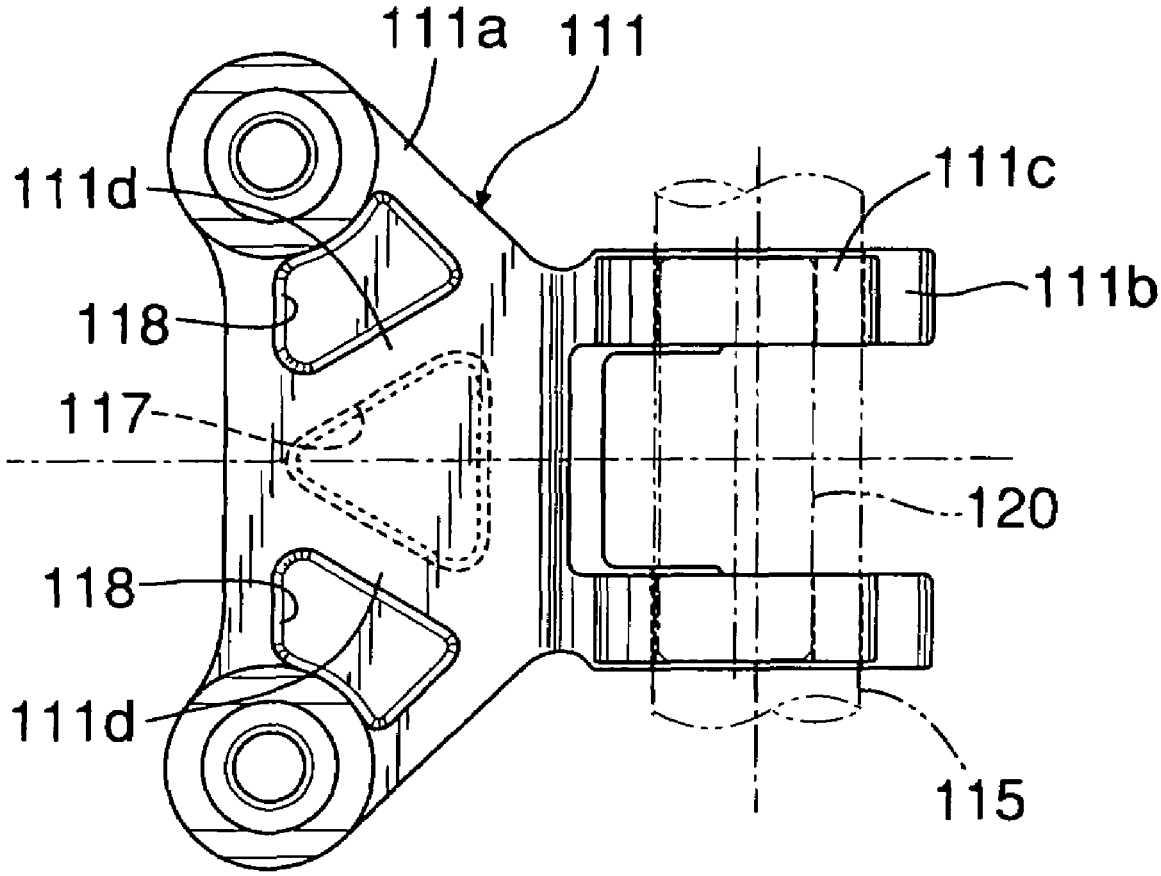
FIG. 16 is a bottom view of an intake rocker arm as viewed from the direction shown by arrow 16 in FIG. 15. Embodiment 2
Figure 17:
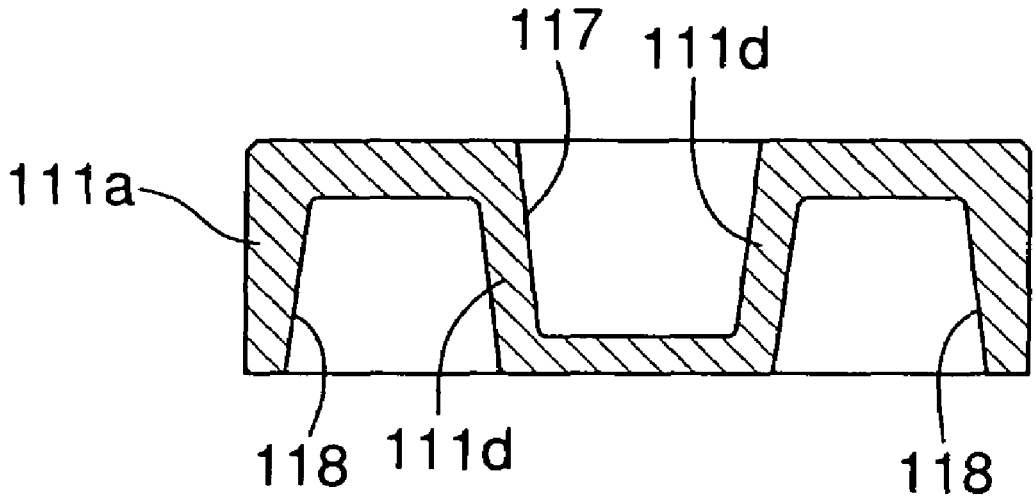
FIG. 17 is a sectional view taken along line 17-17 in FIG. 15. (Embodiment 2)

Referring also to FIGS. 15 to 17, the intake rocker arm 111 is provided with a valve connecting portion 111*a* at its first end; tappet screws 70, 70 that abut against the upper ends of the stems 19*a* of the pair of intake valves 19 are screwed into the valve connecting portion 111*a* so that their advance/retract positions can be adjusted. The intake rocker arm 111 is provided, at its second end, with a first support portion 111*b* and a second support portion 111*c* placed below the first support portion 111*b* so as to communicate with each other. The first and second support portions 111*b* and 111*c* are formed into a substantial U shape that is open in a direction opposite to that in which the U shape of the intake valve 19 is open.

A roller 114 is supported by the first support portion 111*b* of the intake rocker arm 111 via a first connecting shaft 115 and a roller bearing 116; the roller 114 is in rolling contact with the intake valve operating cam 69 of the intake cam shaft 31. The roller 114 is placed so as to be sandwiched between linear portions of the U-shaped first support portion 111*b*.

Figure 18:
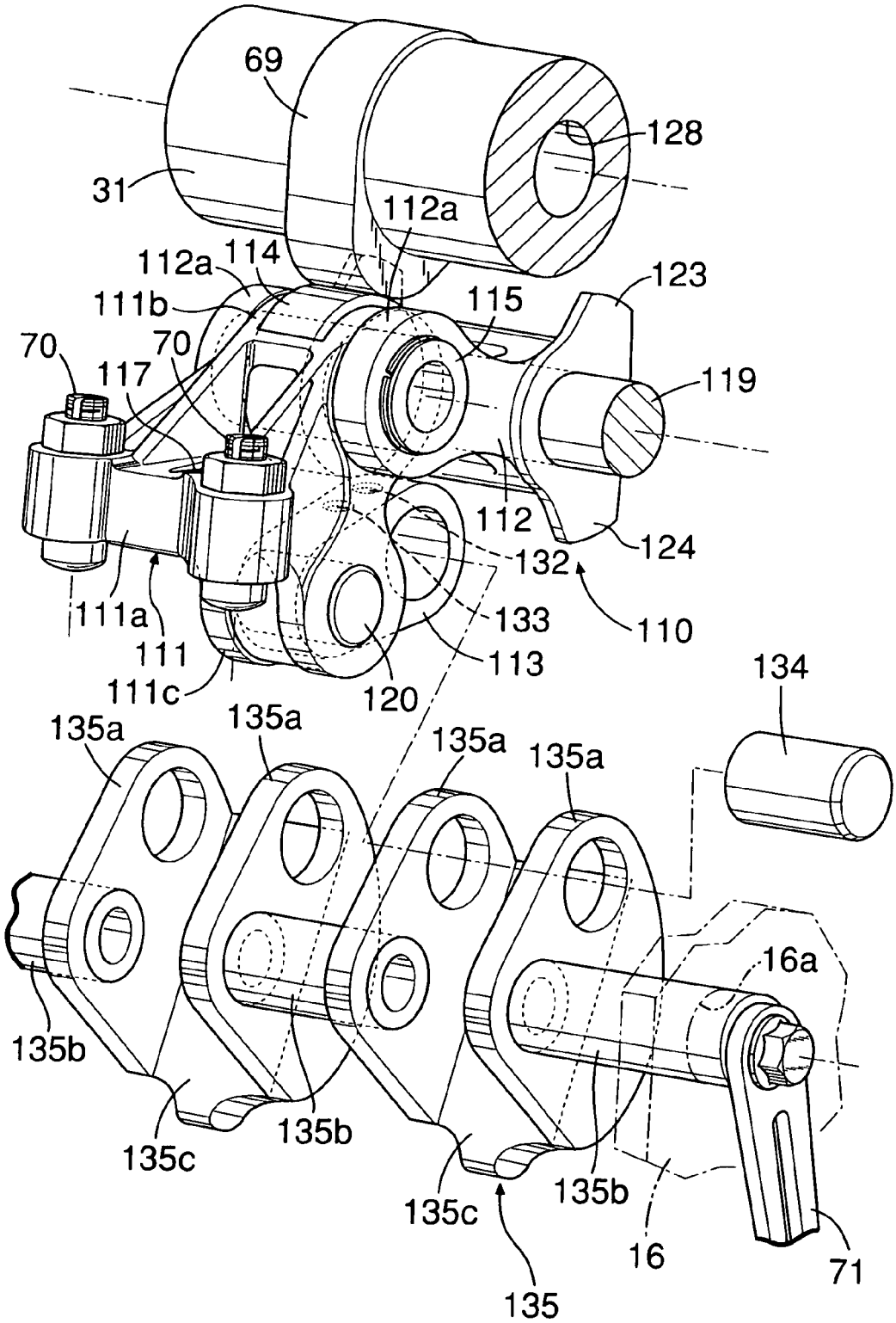
FIG. 18 is a perspective view of the variable lifting mechanism. (Embodiment 2)

Referring also to FIG. 18, the intake rocker arm 111 is molded by, for example, casting a light alloy so that the valve connecting portion 111*a* have a larger width in a direction along the turning axis of the intake valve operating cam 69 than in the remaining part. The first and second connecting portions 111*b* and 111*c* are formed to have the same width.

For example, a substantially triangular lightening portion 117 is formed in a central portion of a top surface of the valve connecting portion 111*a* of the intake rocker arm 111. A pair of lightening portions 118, 118 is formed on the opposite sides of a bottom surface of the valve connecting portion 111*a* which is opposite the top surface so that the lightening portions 118, 118 are alternately arranged.

The lightening portions 117, 118, 118 are molded at the same time when the intake rocker arm 111 is molded. The upper lightening portion 117 has a draft angle corresponding to a direction such that the lightening portion 117 has a larger aperture area closer to the top surface of the valve connecting portion 111*a*. The lower lightening portions 118, 118 have a draft angle corresponding to a direction such that the lightening portions 118, 118 have a larger aperture area closer to the bottom surface of the valve connecting portion 111*a*. Accordingly, an inner flank of the lightening portion 117 has the same inclining direction as inner surfaces of the lightening portions 118, 118. Wall portions 111*d*, 111*d* formed in the valve connecting portion 111*a* between the adjacent lightening portions 117, 118; 117, 118 have a substantially equal thickness.

Figure 19:
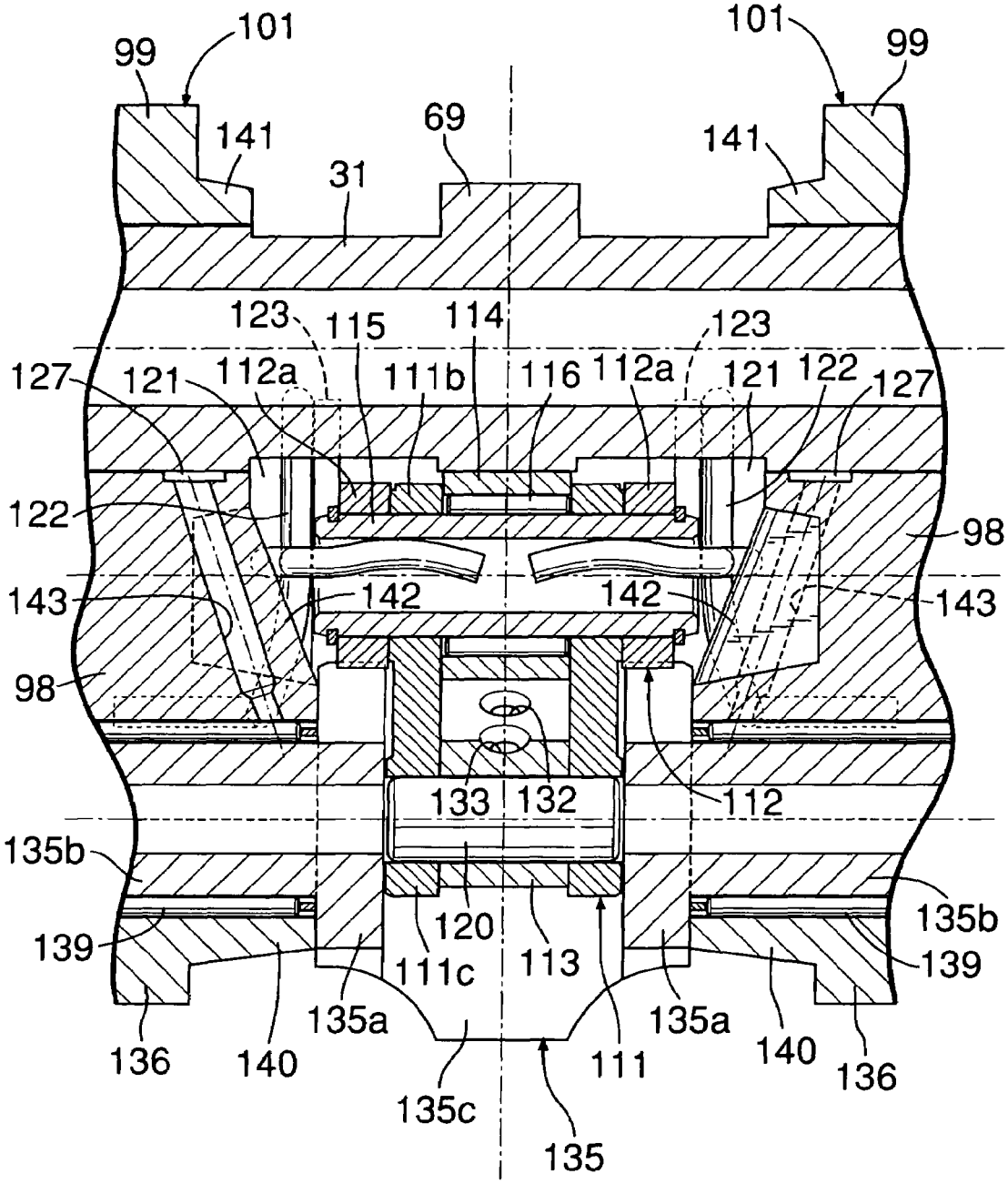
FIG. 19 is a sectional view taken along line 19-19 in FIG. 15. (Embodiment 2)

Referring also to FIG. 19, the first link arm 112 has a pair of connecting portions 112*a*, 112*a* at its first end, the connecting portions 112*a*, 112*a* sandwiching the first support portion 111*b* of the intake rocker arm 111 between them. The first link arm 112 is generally formed into a substantial U shape. The first link arm 112 is turnably connected to the first support portion 111*b* via the first connecting shaft 115, allowing the intake rocker arm 111 to axially support the roller 114. A fixed support shaft 119 turnably supporting the second end of the first link arm 112 is supported by the upper holders 98 tightened to the cylinder head 14.

The first end of the second link arm 113, placed below the first link arm 112, sits so as to be sandwiched between linear portions of the U-shaped second support portion 111*c* of the intake rocker arm 111. The first end of the second link arm 113 is turnably connected to the second support portion 111*c* via a second connecting shaft 120.

On the opposite sides of the second end of the first link arm 112, support bosses 112, 112 are integrated with the upper holders 98, 98 so as to stick out from them, while supporting the fixed support shaft 119. The support bosses 121 regulate the movement of the second end of the first link arm 112 in a direction of the axis of the fixed support shaft 119.

Both intake valves 19 are biased by the valve springs 24 in the valve closing direction. While the intake rocker arm 111 is driving the both intake valves 19 in the valve opening direction, the intake valves 19 being biased by the valve springs 24 in the valve closing direction, the roller 114 of the intake rocker arm 111 is contacted with the intake valve operating cam 69 by the action of the valve springs 24. However, when the intake valves 19 are closed, the spring force of the valve springs 24 does not act on the intake rocker arm 111. The roller 114 may leave the intake valve operating cam 69. This reduces the accuracy with which the valve lift amount is controlled when the intake valves 19 are to be slightly opened. Thus, torsion springs 122 serving as interpositions are provided separately from the valve springs 24; the torsion springs 122 are interpositions placed between the support bosses 121, 121 arranged on the opposite sides of the second end of the first link arm 112. The torsion springs 122 bias the intake rocker arm 111 in a direction in which the roller 114 abuts against the intake valve operating cam 69.

The torsion springs 122 surround the support bosses 121 and are provided between the engine body 10 and the intake rocker arm 111. Specifically, the first ends of the torsion springs 122 are engaged with the support bosses 121. The second ends of the torsion springs 122 are inserted into and engaged with the hollow first connecting shaft 115, operating integrally with the intake rocker arm 111.

The second end of the first link arm 112 is formed into a cylinder such that its outer periphery is placed inward of the outer peripheries of the torsion springs 122 as viewed laterally. A plurality of, for example, a pair of projecting portions 123, 124 is provided at axially opposite ends of the second end of the first link arm 112 and at intervals in a circumferential direction so as to stick out from the second end; the projecting portions 123, 124 inhibit the torsion springs 122 from falling down toward the first link arm 112. Therefore, the torsion springs 122 can be prevented from falling down as described above to improve the supporting rigidity of the second end of the first link arm 112, while avoiding an increase in the size of the second end of the first link arm 112.

Moreover, the projecting portions 123, 124 are arranged outside the operating range of the second link arm 113. Accordingly, even though the projecting portions 123, 124 are provided at the second end of the first link arm 112, the second link arm 113 can be provided with a sufficient operating range.

Oil jets 125 are mounted in the caps 99 of the intake cam holders 101, provided in the engine body 10, to supply oil to the upper part of the second end of the intake rocker arm 111.

A passage 126 is formed in one of the plurality of upper holders 98 to guide oil from an oil pump (not shown). Further, concave portions 127 formed into circular arcs are provided in the top of the upper holders 98 and opposite the lower half of the intake camshaft 31. The passage 126 is in communication with one of the concave portions 127. On the other hand, the intake cam shaft 31 is formed coaxially with an oil passage 128. Communication holes 129 are formed in the intake cam shaft 31 at positions corresponding to the intake cam holders 101 so that their inner ends are in communication with the oil shaft 128 and that their outer ends are opened from an outer surface of the intake cam shaft 31. Lubricating oil is supplied to between each intake cam holder 101 and the intake cam shaft 31 via the communication holes 129.

Concave portions 130 are formed in bottom surfaces of the caps 99, constituting the intake cam holders 101 together with the upper holders 98; each of the concave portions 130 forms a passage between the top surface of the corresponding upper holder 98 and the bottom surface of the corresponding cap 99, the passage leading to the concave portion 127. The oil jets 125 are mounted in the caps 99 so as to communicate with passages 131 formed in the caps 99 and leading to the concave portions 130.

The oil jets 125 are thus mounted in the caps 99 of the intake cam holders 46, provided in the engine body 10 so as to rotatably support the intake cam shaft 31. Consequently, a sufficient amount of oil under a sufficient pressure can be supplied through the oil jets 125 by utilizing an oil path for lubricating between the intake cam shaft 31 and the intake cam holders 101.

Further, oil from the oil jets 125 is supplied to the first connecting shaft 115, which is the upper one of the first and second connecting shafts 115, 120, connecting the first ends of the first and second link arms 112, 113 to the intake rocker arm 111. Consequently, the oil having lubricated between the first link arm 112 and the intake rocker arm 111 flows down to the second link arm 113.

Moreover, oil introduction holes 132, 133 are formed in the second link arm 113 in a direction orthogonal to a straight line joining the axes of the movable support shaft 134 and the second connecting shaft 120 together; the oil introduction holes 132, 133 allow the movable support shaft 134 and the second connecting shaft 120 to partly face the intermediate portion. First ends of the oil introduction holes 132, 133 are opened toward the first connecting shaft 115. Therefore, the oil flowing downward from the first link arm 112 is guided to between the second link arm 113 and both movable support shaft 134 and second connecting shaft 120. It is thus possible to use the simple lubricating structure with a reduced number of parts to lubricate the junction between the intake rocker arm 111 and both first and second link arms 112 and 113 as well as the area between the second link arm 113 and the movable support shaft 134. This ensures smooth valve operations.

The movable support shaft 134, which turnably supports the second end of the second link arm 113, is provided on a single control shaft 135 supported by the engine body 10 and shared by a plurality of cylinders arranged in a line. The control shaft 135 is shaped like a crank and has webs 135*a* and 135*b* arranged on the opposite sides of the intake rocker arm 111, journal portions 135*b*, 135*b* connected at right angles to outer surfaces of proximal ends of the webs 135*a*, 135*a* and turnably supported by the engine body 10, and a connecting portion 135*c* which connects the webs 135*a*, 135*a* together.

Each of the journal portions 135*b* of the control shaft 135 is supported so as to be turnable between the corresponding upper holder 98 coupled to the cylinder head 14 of the engine body 10 and the corresponding lower holder 136 coupled to the upper holder 98 from below. The lower holders 136 are formed separately from the cylinder head 14 so as to be tightened to the upper holders 98. Concave portions 137 are formed in the top surface of the cylinder head 14 so that the lower holders 136 can be arranged in the concave portions 137.

Further, a roller bearing 139 is interposed between each of the upper and lower holders 98 and 136 and the corresponding journal portion 135*b*. The roller bearing 139 can be divided into two parts so as to be interposed between the journal portion 135*b* of the control shaft 135 and each of the upper and lower holders 98 and 136, the control shaft 135 having the plurality of webs 135*a*, 135*a* and connecting portions 135*c* and being shared by the plurality of cylinders.

Control shaft support boss portions 140 are formed on the upper and lower holders 98 and 136 so as to penetrate the journal portions 135*a*; the control shaft support boss portions 140 stick out toward the webs 135*a* of the control shaft 135. On the other hand, cam shaft support boss portions 141 penetrating the intake cam shaft 111 are formed in the upper holders 98 and caps 99 so as to stick out toward the intake rocker arms 111, the upper holders 98 and the caps 99 being coupled together so as to constitute the intake cam holders 101 in conjunction. Ribs 142 are integrated with the upper holders 98 so as to stick out from them; each of the ribs 142 connects the corresponding control shaft support boss portion 140 and the corresponding cam shaft support boss portion 141 together.

Passages 143 are formed in the ribs 142 so as to lead to the concave portions 127 in the top surfaces of the upper holders 98; the passages 143 guide oil to the roller bearings 139.

The swing support portion of the exhaust rocker arm 105 is disposed in the cylinder head 14 so as to lie outside the part of the exhaust rocker arm 105 which is interlocked and connected to the exhaust valves 20. In contrast, the fixed support shaft 119 and the movable support shafts 134 are disposed in the cylinder head 14 so as to line inside the part of the intake rocker arm 111 which is interlocked and connected to the intake valves 19.

A plug cylinder 145 is mounted in the cylinder head 14; an ignition plug 144 attached to the cylinder head 14 is inserted into the plug cylinder 145 so as to face the combustion chamber 15. The plug cylinder 145 is inclined so that its upper part is closer to the exhaust valves 20.

The control shaft 135 is thus placed so that the outer surface of each connecting portion 135*c* lies opposite the plug cylinder 145 between the corresponding intake valve 19 and the corresponding plug cylinder 145. Clearance grooves 146 are formed in the outer surfaces of the connecting portions 135*c* to avoid interferences with the plug cylinders 145.

When the intake valves 19 are closed, the second connecting shaft 120, connecting the second link arm 113 to the intake rocker arm 111, sits coaxially with the journal portions 135*b* of the control shaft 135. When the control shaft 135 swings around the axes of the journal portions 135*b*, the movable support shaft 60 moves on a circular arc centered on the axis of each journal portion 135*b*.

One of the journal portions 135*b* of the control shaft 135 sticks out of the support hole 16*a*, formed in the head cover 16. A control arm 71 fixed to the tip of this journal portion 135*b* is driven by the actuator motor 72 mounted on the outer wall of the cylinder head 14 as in the first embodiment.

According to the second embodiment, in the variable lifting mechanism 110 which continuously varies the lift amount of the intake valves 19, the first ends of the first and second link arms 112 and 113 are relatively turnably connected to the intake rocker arm 111 in parallel, the intake rocker arm 111 having the valve connecting portion 111*a* interlocked and connected to the pair of intake valves 19. The second end of the first link arm 112 is turnably supported by the fixed support shaft 119 supported by the engine body 10. The second end of the second link arm 113 is turnably supported by the displaceable movable support shaft 134.

Therefore, the lift amount of the intake valves 19 can be continuously varied by continuously displacing the movable support shaft 134. This enables the amount of intake to be controlled without the need for any throttle valve. Further, since the first ends of the first and second link arms 112, 113 are turnably connected directly to the intake rocker arm 111, it is possible to reduce the size of the space in which both link arms 112, 113 are arranged and thus the size of the valve operating system. Power from the intake valve operating cam 69 is transmitted directly to the roller 114 of the intake rocker arm 111. This allows the intake rocker arm 111 to properly follow the intake valve operating cam 69. Further, the intake rocker arm 111 and the first and second link arms 112, 113 can be arranged at almost the same position in the direction along the axis of the intake cam shaft 31. This makes it possible to reduce the size of the intake valve operating system in the direction along the axis of the intake cam shaft 31.

Furthermore, the first end of the first link arm 112 is turnably connected to the intake locker arm 111 via the first connecting shaft 115. The roller 114 is supported by the intake rocker arm 111 via the first connecting shaft 115. Consequently, the common first connecting shaft 115 is used to turnably connect the first end of the first link arm 112 to the intake rocker arm 111 and to allow the intake rocker arm 111 to axially support the roller 114. This enables a reduction in the number of parts required and thus a further reduction in the size of the intake valve operating system.

Of intake and exhaust valve operating systems, in the intake valve operating system comprising the variable linking mechanism 110, the fixed support shaft 119 and the movable support shaft 134 are arranged inside the part of the intake rocker arm 111 which is interlocked and connected to the intake valves 19. The swing support portion of the exhaust rocker arm 105 of the exhaust valve operating system is placed outside the part of the exhaust rocker arm 105 which is interlocked and connected to the exhaust valves 20. Consequently, even if the angles of nip a (see FIG. 12) of the intake valves 19 and exhaust valves 20 are set at small values, it is possible to avoid an increase in the size of the cylinder head 14 and thus the interference between the intake valve operating system and the exhaust valve operating system.

The exhaust valve operating system comprises the exhaust cam shaft 103 having the exhaust valve operating cam 107 and the exhaust rocker arm 105, interlocked and connected to the exhaust valve 20, supported by the engine body 10 via the exhaust rocker shaft 104 so as to be able to swing in such a way as to follow the exhaust valve operating cam 107. A plug cylinder 145, placed between the intake valve operating system and the exhaust valve operating system, is mounted in the cylinder head 14 so as to incline in such a manner that its upper part is closer to the exhaust valve operating system. Consequently, the plug cylinder 145 can be placed so as to avoid interferences with the intake and exhaust valve operating systems. This contributes to further reducing the size of the whole cylinder head 14.

The control shaft 135 of the variable linking mechanism 110 is connected to the movable support shaft 134 so as to be angularly displaceable around the axis parallel to that of the movable support shaft 134. The control shaft 135 is supported by the engine body 10 on the opposite sides of the intake rocker arm 111. Consequently, this center impeller type support improves the supporting rigidity of the control shaft. It is thus possible to precisely perform the variable control of the lift amount of the intake valves 19.

Further, the single control shaft 135 is supported by the engine body 10 so as to be shared by the plurality of cylinders arranged in a line. This avoids an increase in the number of parts required, thus enabling a reduction in the size of the engine.

Moreover, the control shaft 135 is shaped like a crank and has the webs 135*a* and 135*b* arranged on the opposite sides of the intake rocker arm 111, the journal portions 135*b*, 135*b* connected at right angles to outer surfaces of proximal ends of the webs 135*a*, 135*a* and turnably supported by the engine body 10, and the connecting portion 135*c* which connects the webs 135*a*, 135*a* together. The movable support shaft 134 is connected to the control shaft 135 so as to link the webs 135*a* and 135*b* together. This makes it possible to enhance the rigidity of the control shaft 135, which is drivingly angularly displaced.

Each of the journal portions 135*b* of the control shaft 135 is supported so as to be turnable between the corresponding upper holder 98 coupled to the cylinder head 14 of the engine body 10 and the corresponding lower holder 136 coupled to the upper holder 98 from below. This enables the control shaft 135 to be assembled more easily and effectively to the engine body 10. Furthermore, the lower holders 136, which are separate from the cylinder head 14, are tightened to the upper holders 98. It is thus possible to increase the degree of freedom in the design of the cylinder head 14 in connection with the support of the control support 135.

Further, the roller bearing 139 each of which can be divided into two parts is interposed between each of the upper and lower holders 98 and 136 and the corresponding journal portion 135*b*. This enables the control shaft 135 to be assembled more easily and effectively, while reducing frictional losses in the support portion for the control shaft 135.

The interconnected upper and lower holders 98 and 136 are formed with the control shaft support boss portions 140, sticking out toward the webs 135*a* of the control shaft 135. The journal portion 135*b*, penetrating each of the control shaft support boss portions 140, is supported so as to be turnable between each of the upper holders 98 and the corresponding lower holder 136. This further enhances the rigidity of the control shaft 135.

The cam shaft support boss portions 141, sticking out toward the intake rocker arms 111, are formed on the upper holders 98 and the caps 99, coupled to the upper holders 98 from above. The intake cam shaft 111 penetrates the cam shaft support boss portions 141 and is rotatably supported between each of the upper holders 98 and the corresponding cap 99. This improves the supporting rigidity of the intake cam shaft 111, while minimizing the number of parts required to support the intake cam shaft 111.

Moreover, the rib 142 sticks out from each of the upper holders 98 to connect the corresponding control shaft support boss portion 140 and the corresponding cam shaft support boss portion 141 together. This further enhances the supporting rigidity of the control shaft 135 and intake cam shaft 111.

The control shaft 135 is placed between the intake valves 19 and the plug cylinder 145, provided in the cylinder head 14, so that the outer surface of the connecting portion 135*c* lies opposite the plug cylinder 145. The clearance groove 146 is formed in the outer surface of the connecting portion 135*c*. This enables the plug cylinder 145 to be placed closer to the intake valve operating system. Therefore, the size of the engine can be reduced.

Further, in the intake rocker arm 111, the lightening portions 117, 118, 118 are alternately formed in the opposite surfaces of the valve connecting portion 111*a*. Consequently, the weight of the intake rocker arm 111 can be reduced.

The lightening portions 117, 118, 118 are molded at the same time when the intake rocker arm 111 is molded. Since the adjacent lightening portions 117, 118; 117, 118 have the draft angles corresponding to the opposite directions, the inner surfaces of the adjacent lightening portions 117, 118; 117, 118 are inclined in the same direction. Therefore, the wall portions 111*d*, 111*d*, formed in the intake rocker arm 111 between the adjacent lightening portions 117, 118; 117, 118 have the substantially equal thickness. The rigidity of the intake rocker arm 111 can be maintained using the wall portions 111*d*, 111*d* having the substantially equal thickness.

Furthermore, the variable lifting mechanism 110 can continuously vary the lift amount of the intake valves 19. Accordingly, even for a valve operating system that is likely to have a relatively large number of parts and thus an increased weight, its weight can be reduced by lightening the intake rocker arm 111. This makes it possible to increase a critical rotation speed.

The embodiments of the present invention have been described. However, the present invention is not limited to these embodiments. Various changes may be made to the design of the embodiments without departing from the present invention set forth in the claims.

The invention claimed is:

1. An engine valve operating system comprising a rocker arm (63, 111) which has a cam abutting portion (65, 114) abutting against a valve operating cam (69) and is interlocked and connected to an engine valve (19), a first link arm (61, 112) having one end turnably connected to the rocker arm (63, 111) and the other end turnably supported at a fixed position of the engine body (10), a second link arm (62, 113) having one end turnably connected to the rocker arm (63, 111) and the other end turnably supported by a displaceable movable support shaft (68*a*, 134), and driving means (72) connected to the movable support shaft (68*a*, 134) to enable a position of the movable support shaft (68*a*, 134) to be displaced in order to continuously vary the lift amount of the engine valve (19), wherein the rocker arm (63, 111) having a valve connecting portion (63*a*, 111*a*) into which tappet screws (70) abutting against a pair of engine valves (19) are screwed so that their advance/retract positions can be adjusted and a first and second support portions (63*b*, 63*c*; 111*b*, 111*c*) to which the one ends of the first and second link arms (61, 62; 112, 113) are turnably connected is formed so that the valve connecting portion (63*a*, 111*a*) has a larger width in a direction along a rotating axis of the valve operating cam (69) than in a remaining part.

2. The engine valve operating system according to claim 1, wherein the other end of the first link arm (61, 111) is turnably supported via a support shaft (67, 119) by support walls (44*a*, 98) provided in the engine body (10) so as to lie on opposite sides of the other end of the first link arm (61, 112), and an interposition (54, 122) is placed between the other end of the first link arm (61, 112) and each of the support walls (44*a*, 98).

3. The engine valve operating system according to claim 2, wherein the interposition (54, 112) is a torsion spring provided between the engine body (10) and the rocker arm (63, 111) so as to bias the rocker arm (63, 111) in a side in which the cam abutting portion (65, 114) abuts against the valve operating cam (69).

4. The engine valve operating system according to claim 1, wherein the first support portion (63*b*, 111*b*) is formed into a substantially U-shape so as to sandwich a roller (65, 114) which is the cam abutting portion, between the opposite sides, and the roller (65, 114) is rotatably supported by the first support portion (63*b*, 111*b*).

5. The engine valve operating system according to claim 4, wherein a pair of connecting portions (61*a*, 112*a*) is provided at the one end of the first link arm (61, 112) so as to sandwich the first support portion (63*b*, 111*b*) of the rocker arm (63, 111) between the connecting portions (61*a*, 112*a*), the connecting portions (61*a*, 112*a*) are turnably connected to the first support portion (63*b*, 111*b*) via a connecting shaft (64, 115), and the roller (65, 114) is axially supported by the first support portion (63*b*, 111*b*) via the connecting shaft (64, 115).

6. The engine valve operating system according to claim 1, wherein the rocker arm (63, 111) is formed so that the first and second support portions (63*b*, 63*c*; 111*b*, 111*c*) have the same width.

7. The engine valve operating system according to claim 1, wherein connecting holes (49, 50) through which connecting shafts (64, 66) used to turnably connect the one ends of the first and second link arms (61, 62) are inserted are formed in the first and second support positions (63*b*, 63*c*) so as to be side by side in a direction of opening/closing operations of the engine valves (19), and the first and second support portions (63*b*, 63*c*) are connected together by a connecting wall (63*d*) at least partly placed opposite from the engine valves (19) with respect to a tangent (L) contacting with outer edges of the connecting holes (49, 50) near the engine valves (19).

8. The engine valve operating system according to claim 7, wherein a concave portion (51) is formed in the connecting wall (63*d*) at a position opposite from the other end of the second link arm (62) when the other end of the second link arm (62) is closest to the rocker arm (63).

9. The engine valve operating system according to claim 7, wherein a lightening portion (52) is formed in the connecting wall (63*d*).

10. The engine valve operating system according to claim 1, wherein lightening portions (117, 118) are alternately formed in opposite surfaces of the rocker arm molded.

* * * * *